US010784620B2

(12) United States Patent
Azad

(10) Patent No.: US 10,784,620 B2
(45) Date of Patent: Sep. 22, 2020

(54) METHOD OF OPERATING A CONNECTOR LATCH FOR A HOUSING

(71) Applicant: J.S.T. Corporation, Farmington Hills, MI (US)

(72) Inventor: Vikas Azad, Novi, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 63 days.

(21) Appl. No.: 15/854,295

(22) Filed: Dec. 26, 2017

(65) Prior Publication Data

US 2019/0199034 A1 Jun. 27, 2019

(51) Int. Cl.

| | |
|---|---|
| ***H01R 13/627*** | (2006.01) |
| ***H01R 13/506*** | (2006.01) |
| ***H01R 13/641*** | (2006.01) |
| ***H01R 13/631*** | (2006.01) |
| ***H01R 43/26*** | (2006.01) |

(52) U.S. Cl.
CPC ..... *H01R 13/6272* (2013.01); *H01R 13/506* (2013.01); *H01R 13/6315* (2013.01); *H01R 13/641* (2013.01); *H01R 43/26* (2013.01)

(58) Field of Classification Search
CPC ..... H01R 13/6272; H01R 13/6315; H01R 13/506; H01R 13/641; H01R 13/6723; H01R 13/4223; H01R 13/428; H01R 13/508; H01R 12/7017; H01R 12/7023
See application file for complete search history.

(56) References Cited

U.S. PATENT DOCUMENTS 5,330,369 A 7/1994 Nozaki et al.
5,584,719 A * 12/1996 Tsuji ..... H01R 13/6272 439/354
5,628,649 A 5/1997 Yagi et al.
5,759,058 A 6/1998 Childs et al.
(Continued)

FOREIGN PATENT DOCUMENTS

EP 0862244 A1 9/1998
EP 1096616 A2 5/2001
EP 1926183 A2 5/2008

OTHER PUBLICATIONS

Extended European Search Report in European Application No. 17191762.8, dated Dec. 12, 2017.
Extended European Search Report in counterpart European Application No. 17191751.1, dated Mar. 27, 2018.
USPTO Office Action in U.S. Appl. No. 15/384,755, dated Jul. 26, 2017.
(Continued)

*Primary Examiner* — Jun S Yoo
(74) *Attorney, Agent, or Firm* — Kratz, Quintos & Hanson, LLP

(57) ABSTRACT

Method of operating a connector latch used to securely hold together a connector apparatus, wherein the connector apparatus has at least a first housing and a second housing which can be mated together. Initially, after the connector latch is manufactured, the connector latch is in an undeflected position. After manufacture, the connector latch is subjected to a pre-mating deflection process, in order to deflect the connector latch into a preloaded position. After the pre-mating deflection process has been completed, the connector latch is locked in the preloaded position. The preloaded connector latch provides a number of desirable characteristics, including at least an extra loud "click" sound when the connecting latch is operated to mate the first housing with the second housing.

11 Claims, 46 Drawing Sheets

(56) References Cited

U.S. PATENT DOCUMENTS

| | | | | |
|---|---|---|---|---|
| 5,823,813 | A | 10/1998 | Dye | |
| 6,116,939 | A * | 9/2000 | Fukuda | H01R 13/6272 439/354 |
| 6,186,819 | B1 | 2/2001 | Holub | |
| 6,312,277 | B1 | 11/2001 | Holub | |
| 6,435,895 | B1 | 8/2002 | Fink et al. | |
| 7,909,638 | B2 | 3/2011 | Seo et al. | |
| 8,747,146 | B2 | 6/2014 | Brown et al. | |
| 8,920,187 | B2 | 12/2014 | Kon et al. | |
| 2002/0045380 | A1 | 4/2002 | Endo et al. | |
| 2002/0119693 | A1 * | 8/2002 | Chen | H01R 13/6272 439/358 |
| 2003/0171027 | A1 | 9/2003 | Shuey et al. | |
| 2004/0067676 | A1 | 4/2004 | Nimura | |
| 2004/0248453 | A1 | 12/2004 | McLauchlan et al. | |
| 2012/0282791 | A1 | 11/2012 | Brown et al. | |
| 2016/0164224 | A1 | 6/2016 | Sekino | |
| 2016/0372867 | A1 * | 12/2016 | Upson | H01R 13/4361 |
| 2017/0062982 | A1 | 3/2017 | Holub et al. | |
| 2017/0062983 | A1 | 3/2017 | Holub et al. | |
| 2017/0179643 | A1 | 6/2017 | Holub | |
| 2017/0179646 | A1 | 6/2017 | Holub | |

OTHER PUBLICATIONS

USPTO Office Action in U.S. Appl. No. 15/384,755, dated Mar. 21, 2018.
USPTO Office Action in U.S. Appl. No. 15/384,743, dated Feb. 16, 2018.
USPTO Office Action in U.S. Appl. No. 15/384,743, dated Jul. 27, 2017.
USPTO Office Action in U.S. Appl. No. 15/243,008, dated May 3, 2018.
USPTO Office Action in U.S. Appl. No. 15/243,023, dated Oct. 27, 2017.
USPTO Office Action in U.S. Appl. No. 15/243,023, dated Apr. 17, 2018.
Extended European Search Report in European Application No. 17187151.0, dated Jan. 18, 2018.
Extended European Search Report in European Application No. 17187152.8, dated Jan. 18, 2018.
U.S. Appl. No. 29/637,985, filed Feb. 23, 2018.
U.S. Appl. No. 29/637,988, filed Feb. 23, 2018.
U.S. Appl. No. 15/854,287, filed Dec. 26, 2017.

* cited by examiner

METHOD OF OPERATING A CONNECTOR LATCH FOR A HOUSING

BACKGROUND OF THE INVENTION

The present invention generally relates to a method of operating a connector latch used to securely mate a first housing with a second housing.

BRIEF SUMMARY OF THE INVENTION

When the connector latch of the present invention is manufactured, the connector latch initially exists in an undeflected position. The connector latch is then subjected to a pre-mating deflection process, in order to deflect the connector latch and lock the connector latch in a preloaded position. After the pre-mating deflection process has been completed, the connector latch is locked in a preloaded position and can be referred to as a preloaded connector latch.

The preloaded connector latch provides a number of desirable characteristics, including at least, for example: an audible "click" sound when a first housing and a second housing are mated together, which is an extra loud sound; a low profile; a resistance to permanent set; and good dimensional control of latching geometry.

It is a desirable trait to have an audible "click" sound. For example, when components of an automotive connector are completely mated with each other, it is a desirable trait to have an audible "click" sound for convenient assurance that the components are completely mated. In the automotive connector field, an extra loud sound is favorable. It is desirable to have the loudest "click" sound possible. The "click" sound can be achieved by an interaction of latching features, for example. By placing latching features in a preloaded condition, there is additional force when a first housing and a second housing are mated together, and that additional force helps to make the "click" sound louder than it would have been if the latching features had not been in a preloaded condition.

It is a desirable trait to have a low profile. By manufacturing the connector latch in an undeflected position, the gaps required to create overstress protection features, to prevent the connector latch from being pried in the wrong direction and damaged, are not needed. The gaps can be removed from the overall height of the latch system, so that the connector latch can have a low profile.

It is a desirable trait to have a resistance to being permanently set. For example, when automotive wire harnesses are bundled for shipment, the connector latches can be unintentionally compressed and held in a deflected position. Especially in hot environments, this condition causes the connector latch to be permanently deflected, also known as permanently set, thus rendering the connector latch useless or less effective. Preloading the connector latch makes the connector latch more resistant to this failure mode.

It is a desirable trait to have good dimensional control of latching geometry. By preloading the connector latch against dimensionally stable features, the height of the connector latch features can be controlled easily.

When a first housing and a second housing are engaged together, the engagement thereof is assured because the connector latch causes an audible "click" sound. A first housing can correspond to a female housing or other type of housing, for example. A second housing can correspond to a male housing or other type of housing, for example. The undeflected position can also be referred to as an extended and relaxed undeflected position.

Additional features, advantages, and embodiments of the invention are set forth or are apparent from consideration of the following detailed description, drawings and claims. Moreover, it is to be understood that both the foregoing summary of the invention and the following detailed description are exemplary and are intended to provide further explanation without limiting the scope of the invention as claimed.

DETAILED DESCRIPTION OF THE PREFERRED EMBODIMENTS

Figure 1:
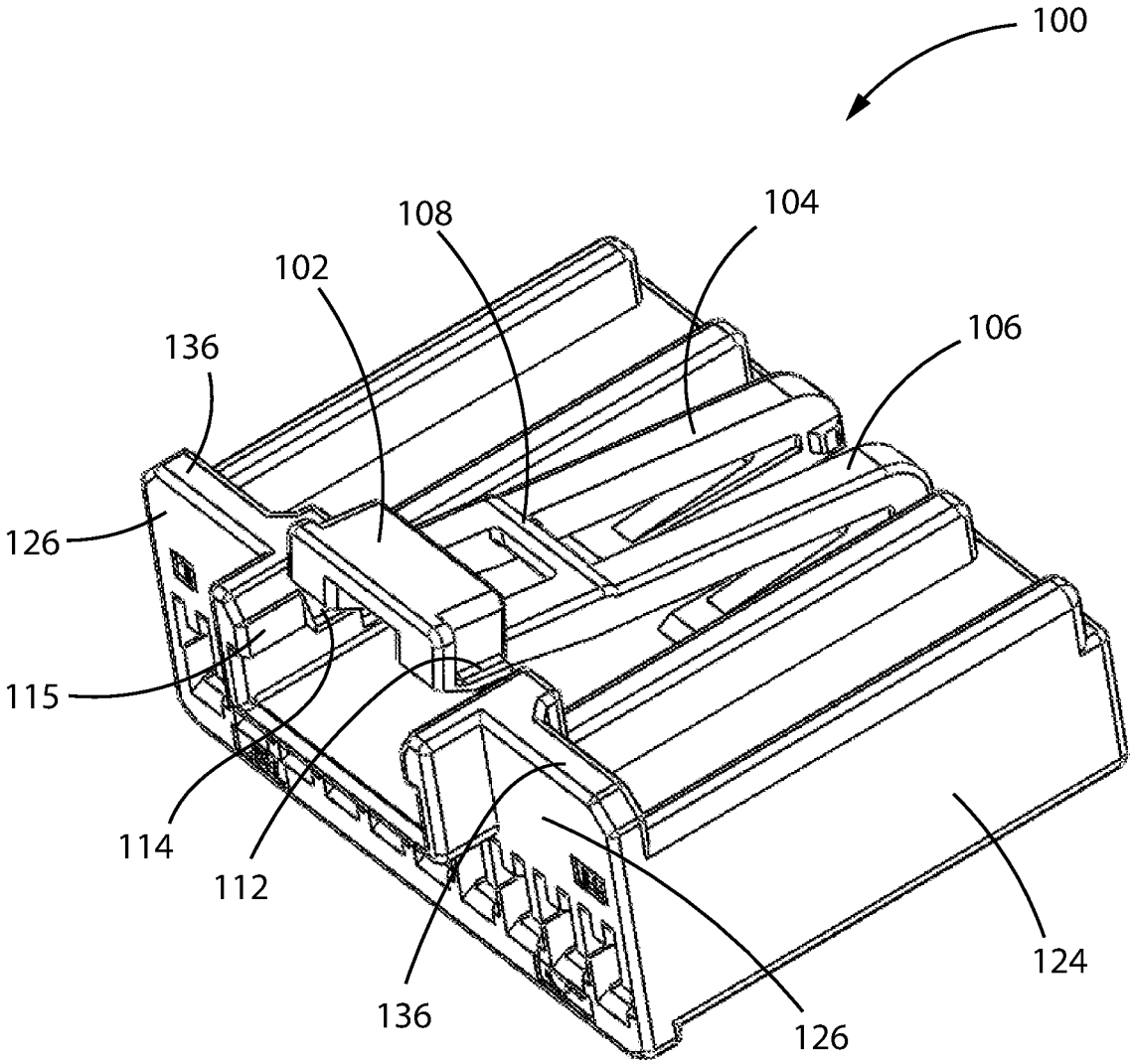
FIG. 1 is a first perspective view of a female housing having a connector latch in accordance with the principles of the present invention, showing the connector latch in an undeflected position, without a connector position assurance (CPA) unit shown.

FIG. 1 is a first perspective view of a female housing having a connector latch in accordance with the principles of the present invention, showing the connector latch in an undeflected position, without a connector position assurance (CPA) unit shown.

FIG. 1 illustrates a female housing, generally referred to by reference numeral 100, which includes a connector latch having at least a button 102, a first latch beam 104, a second latch beam 106 and a latch surface 108. Reference numeral 136 denotes a top surface of the female housing 100. FIG. 1 also shows a front 126 of the female housing 100, a second overstress protection surface 112 on a side of the button 102, a first frame 114 of the female housing 100, a first interior side wall 115 of the female housing 100, and a second side 124 of the female housing 100.

Figure 4:
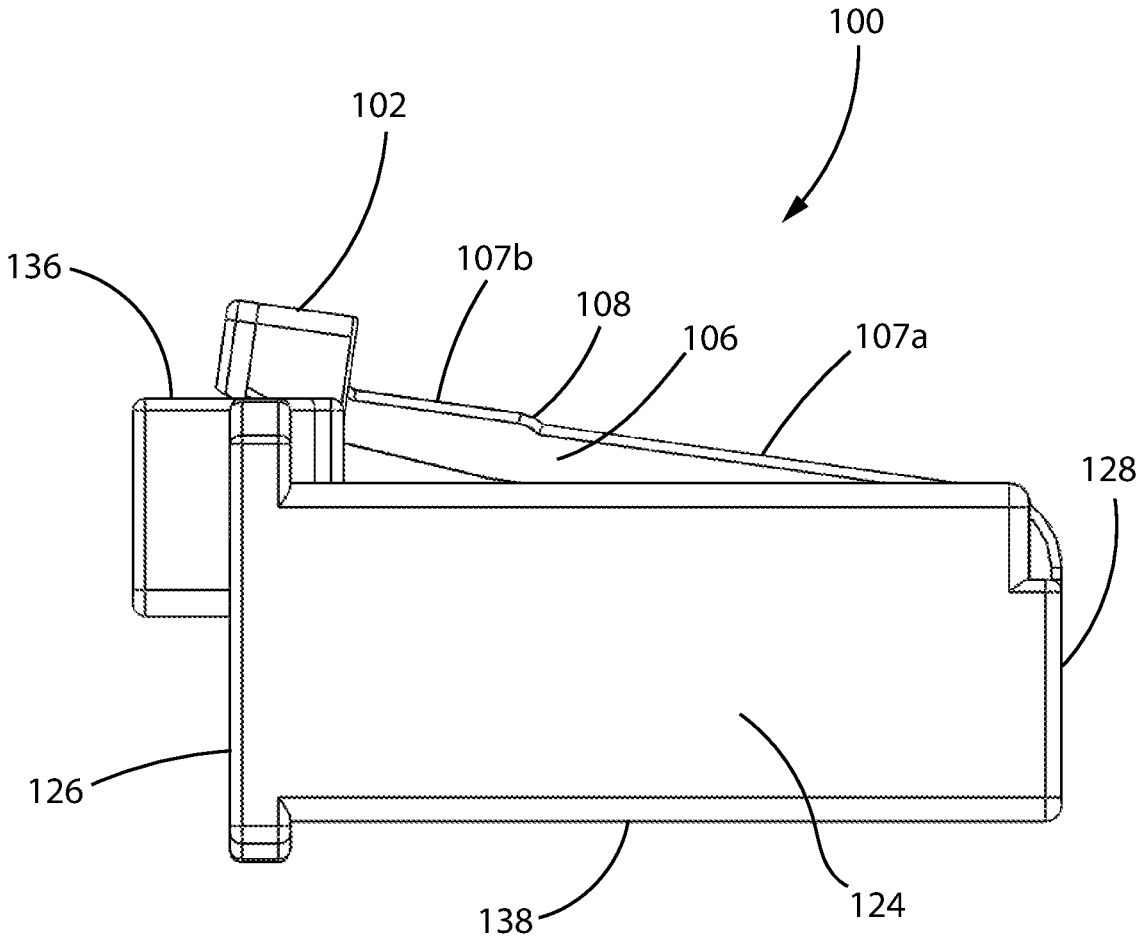
FIG. 4 is a side elevational view of the female housing shown in FIG. 1.

The first latch beam 104 and second latch beam 106 are flexible, and permit the button 102 to move up and down without breaking. The resting position of the latch beams 104 and 106 is shown in FIG. 1, which is a position wherein the button 102 is extended upward above the top 136 of the female housing 100, which corresponds to the position of the latch beams 104 and 106 when manufactured. When the button 102 is pushed down toward bottom 138, then the beams 104 and 106 bend down, without breaking, to permit the button 102 to be moved downward. The bottom 138 of the female housing 100 is shown in FIG. 4.

Figure 2:
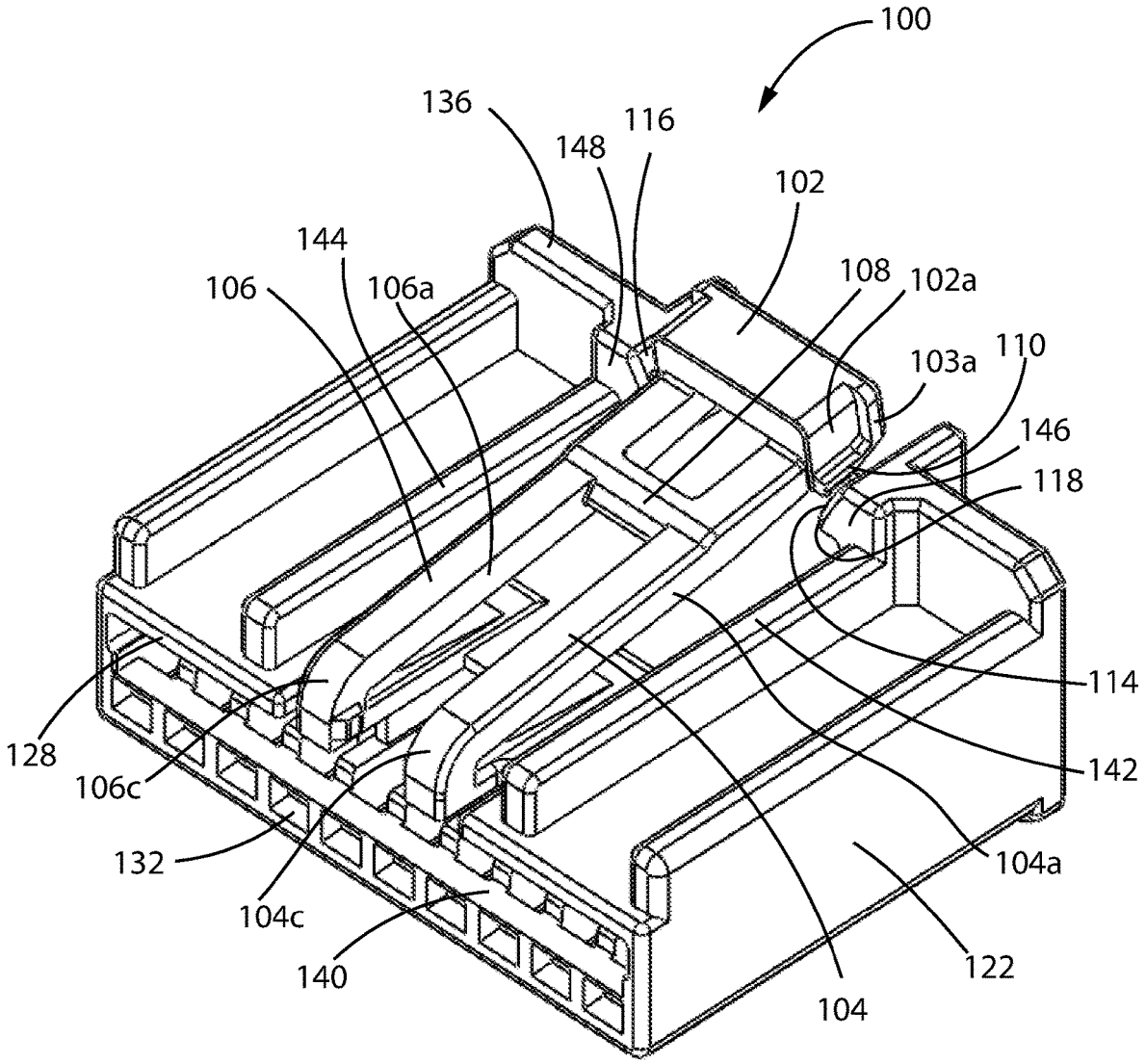
FIG. 2 is a second perspective view of the female housing shown in FIG. 1.

FIG. 2 is a second perspective view of the female housing shown in FIG. 1. FIG. 2 illustrates the female housing 100 having at least a first overstress protection surface 110 on a side of the button 102, a first frame 114 of the female housing 100, a first overstress protection surface 118 on the first frame 114 of the female housing 100, a first side 122 of the female housing 100, a rear 128 of the female housing 100, and at least one terminal aperture 132 on the rear 128 of the female housing 100.

FIG. 2 also depicts a first side wall 102*a* of the button 102, a first side front edge 103*a* of the button 102, first side 104*a* of the first latch beam 104, a hinge area 104*c* of the first latch beam 104, a first side 106*a* of the second latch beam 106, a hinge area 106*c* of the second latch beam 106, a second frame 116 of the female housing 100, and an aperture 140 for receiving an optional terminal position assurance (TPA) unit.

FIG. 2 additionally shows a first rib 142 on a first side of the female housing 100, a first rib 144 on a second side of the female housing 100, a rear surface 146 of a front wall on a first side of the female housing 100, and a rear surface 148 of a front wall on a second side of the female housing 100.

The first latch beam 104 has a first end which has a curved portion in a region where the first latch beam 104 meets a body portion of the female housing 100, just above the terminal apertures 132, as shown in FIG. 2, at the hinge area 104*c*. The first latch beam 104 has a distal end where the first latch beam 104 meets the button 102.

The second latch beam 106 has a first end which has a curved portion in a region where the second latch beam 106 meets a body portion of the female housing 100, just above the terminal apertures 132, as shown in FIG. 2, at the hinge area 106*c*. The second latch beam 106 has a distal end where the second first latch beam 106 meets the button 102. The button 102 is at a distal end of the first latch beam 104 and a distal end of the second latch beam 106, as shown in FIG. 2.

Figure 3:
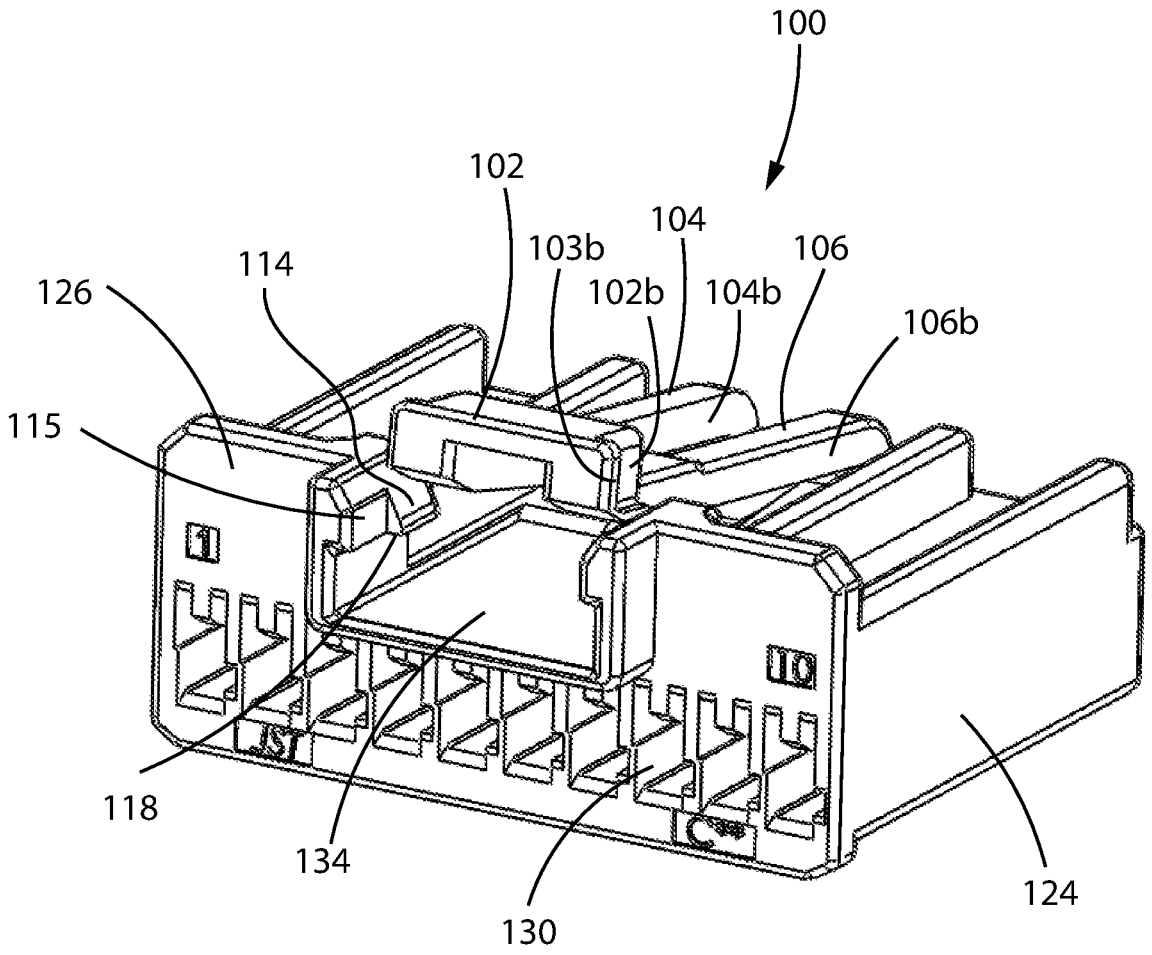
FIG. 3 is a third perspective view of the female housing shown in FIG. 1.

FIG. 3 is a third perspective view of the female housing shown in FIG. 1. FIG. 3 illustrates at least a front 126 of the female housing 100, at least one terminal aperture 130 on the front 126 of the female housing 100, and an aperture 134 formed on the front 126 of the female housing 100 such that the aperture 134 is for receiving an optional connector position assurance (CPA) unit.

FIG. 3 also depicts a second side wall 102*b* of the button 102, a second side front edge 103*b* of the button 102, a second side 104*b* of the first latch beam 104, and a second side 106*b* of the second latch beam 106.

The first side 106*a* of the second latch beam 106 can also be referred to as an inner side 106*a* of the second latch beam 106. The second side 106*b* of the second latch beam 106 can also be referred to as an outer side 106*b* of the second latch beam 106.

The first side 104*a* of the first latch beam 104 can also be referred to as an outer side 104*a* of the first latch beam 104. The second side 104*b* of the first latch beam 104 can also be referred to as an inner side 104*b* of the first latch beam 104.

FIG. 4 is a side elevational view of the female housing shown in FIG. 1. FIG. 4 depicts the bottom 138 of the female housing 100, a lower section 107*a* of the second latch beam 106, and an upper section 107*b* of the second latch beam 106.

Figure 5:
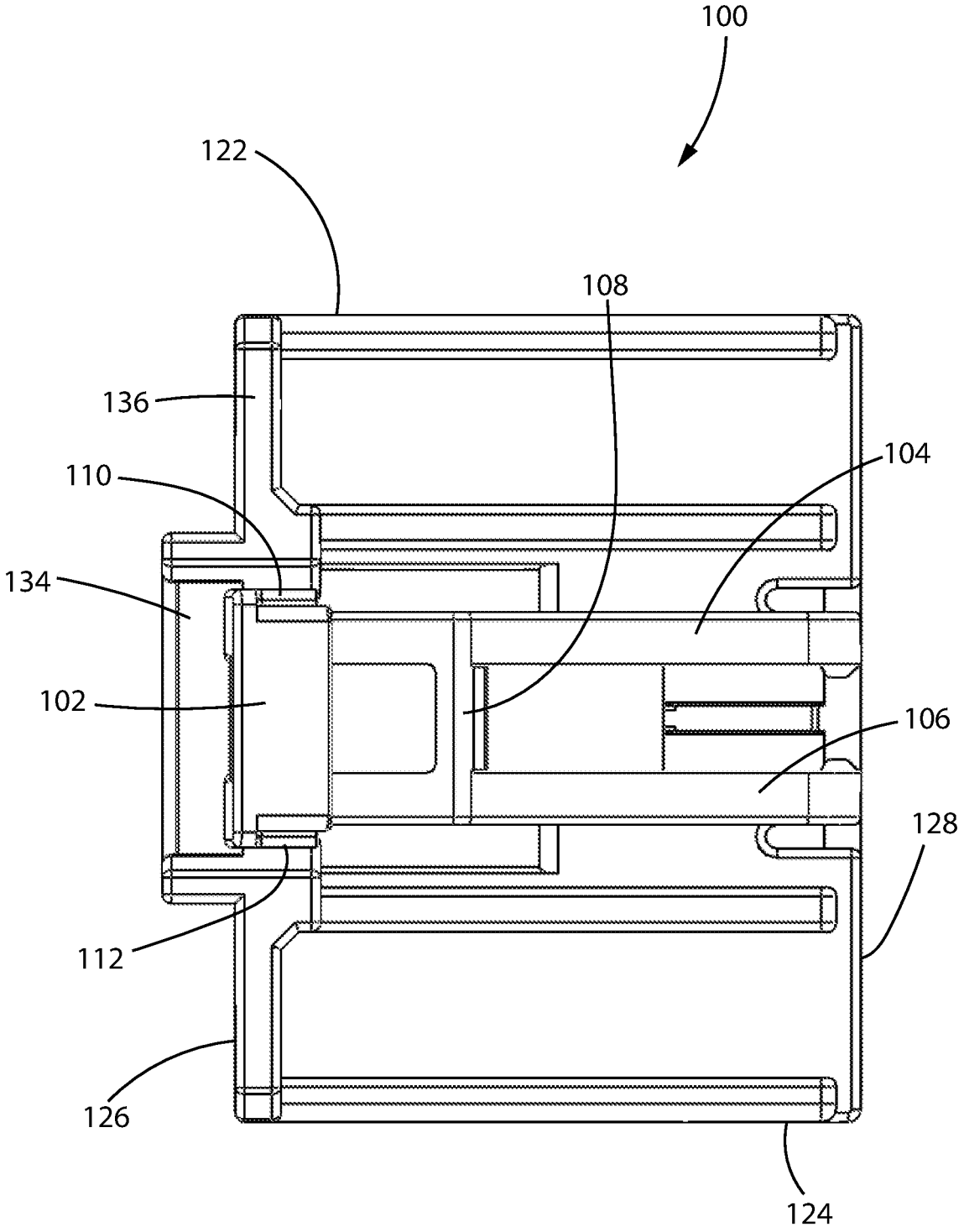
FIG. 5 is a top elevational view of the female housing shown in FIG. 1.
Figure 6:
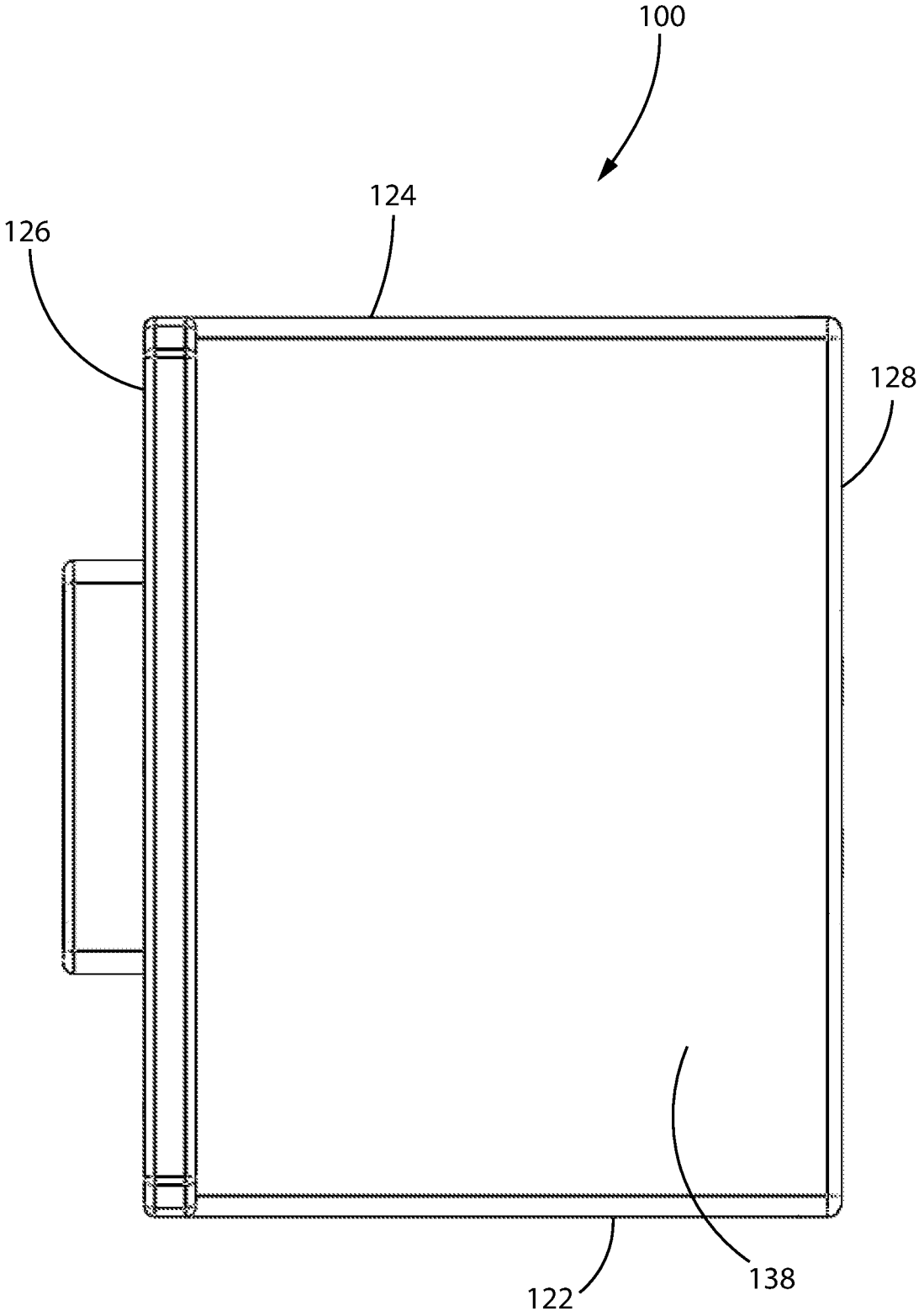
FIG. 6 is a bottom elevational view of the female housing shown in FIG. 1.

FIG. 5 is a top elevational view of the female housing shown in FIG. 1. FIG. 6 is a bottom elevational view of the female housing shown in FIG. 1.

Figure 7:
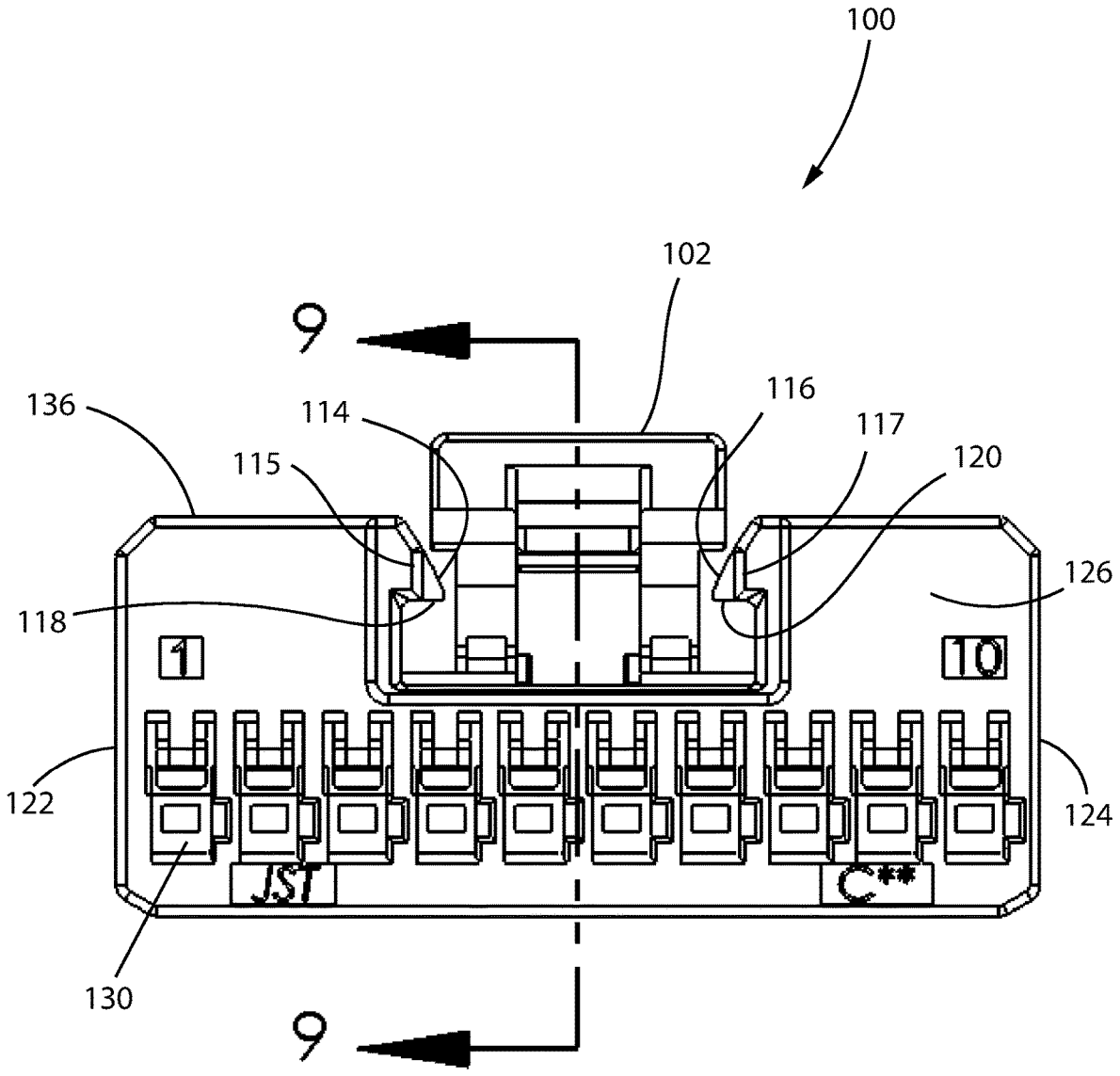
FIG. 7 is a front end elevational view of the female housing shown in FIG. 1.

FIG. 7 is a front end elevational view of the female housing shown in FIG. 1. FIG. 7 depicts a second frame 116 of the female housing 100, a second overstress protection surface 120 on the second frame 116 of the female housing 100, and a second interior side wall 117 of the female housing 100.

Figure 8:
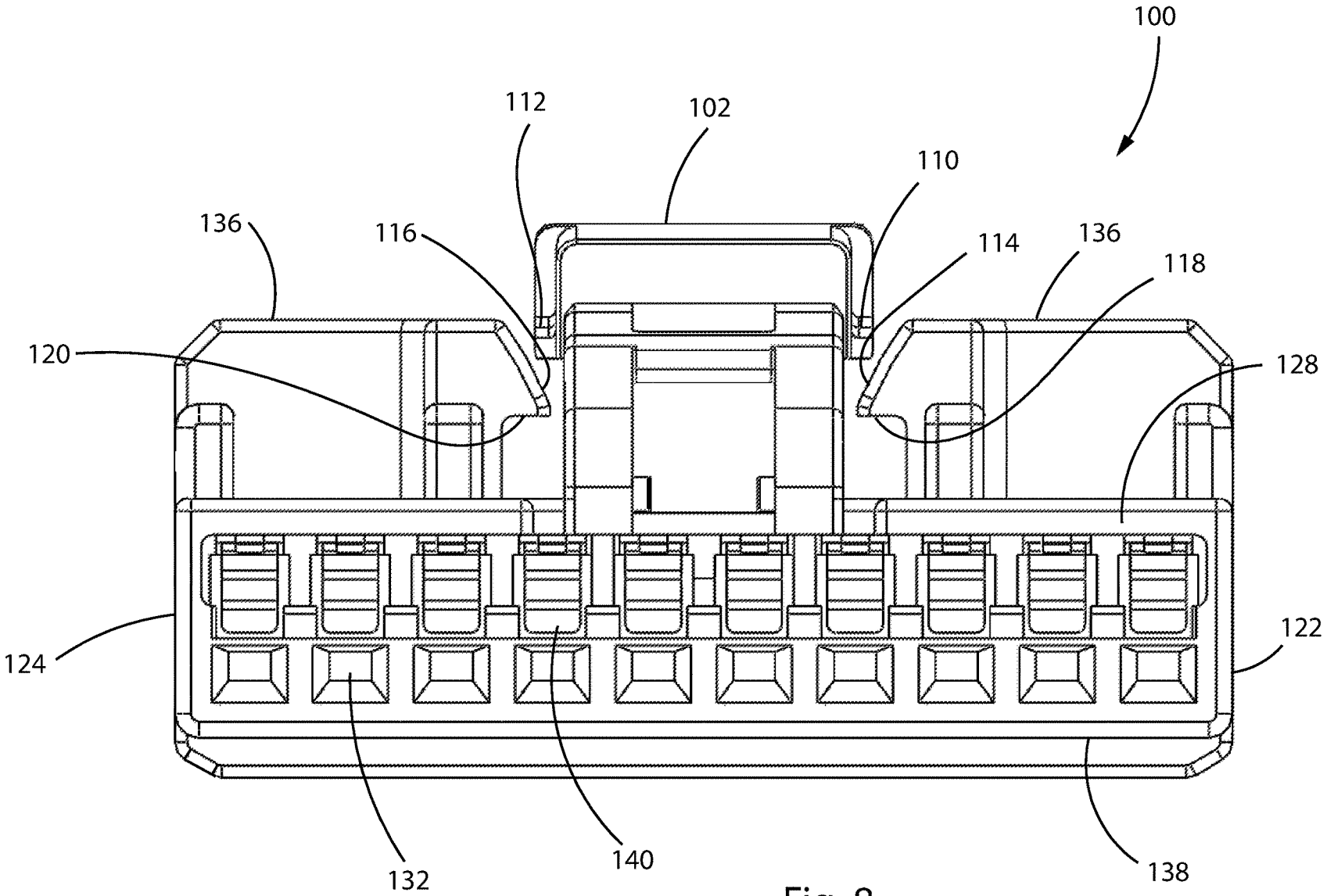
FIG. 8 is a rear end elevational view of the female housing shown in FIG. 1.
Figure 9:
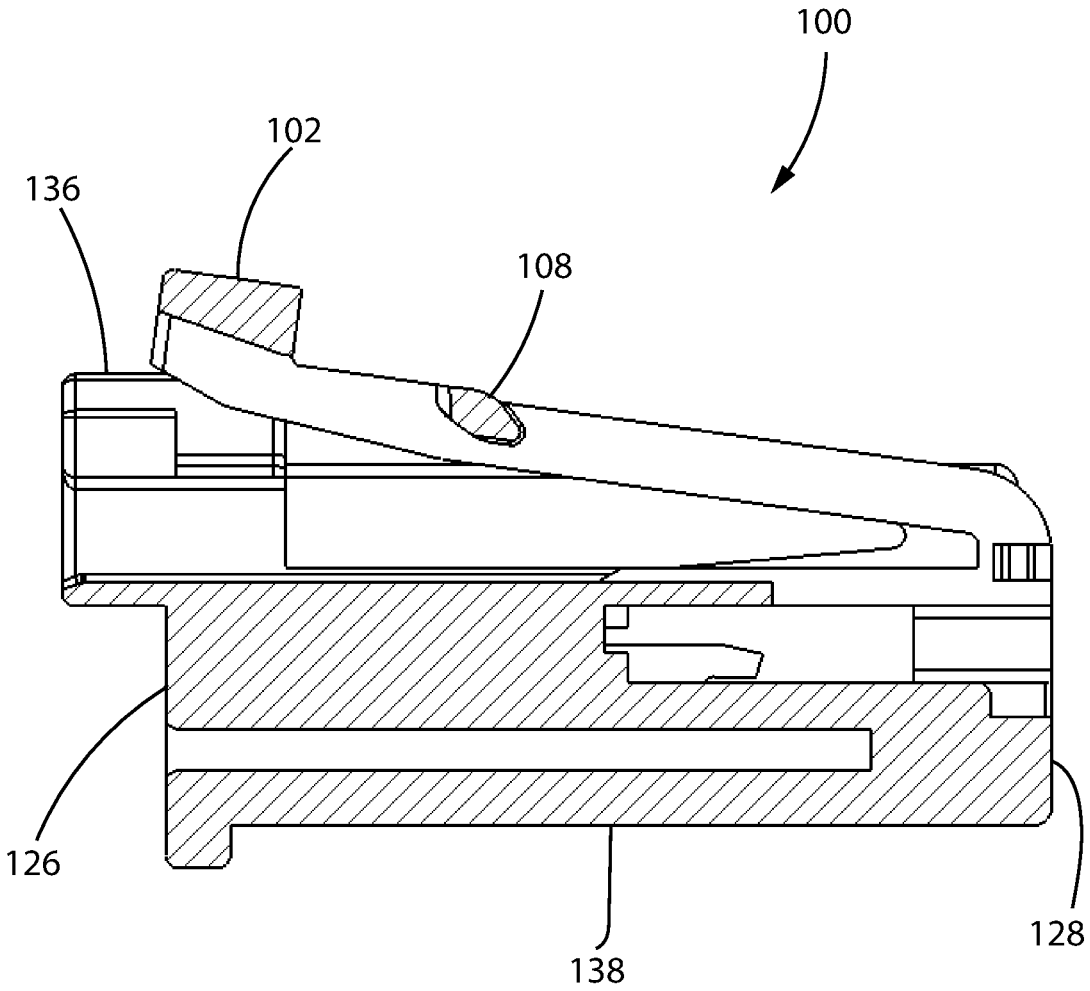
FIG. 9 is a cross-sectional view, taken along line 9-9 in FIG. 7, of the female housing.

FIG. 8 is a rear end elevational view of the female housing shown in FIG. 1. FIG. 9 is a cross-sectional view, taken along line 9-9 in FIG. 7, of the female housing.

The resting position of the button 102 is shown in FIGS. 1-9. With reference to FIG. 8, if a user gently pushes or deflects the button 102 only slightly down toward the bottom 138, while being careful to keep surface 112 above surface 120 and being careful to keep surface 110 above surface 118, then the button 102 will spring back upward to the button's resting position when the user releases the button 102. In this scenario, the button 102 springs back upward to its resting position because the user temporarily deflected the button 102 (and flexible latch beams 104, 106) downward, and then the user released the button 102 which enabled the button 102 and latch beams 104, 106 to rise up again to go back to their resting position.

After the connector latch of the present invention is manufactured, the connector latch is in the extended and relaxed undeflected position. FIGS. 1-9 depict the female housing 100 showing the connector latch in the extended and relaxed undeflected position. As shown in FIG. 1, the button 102 is extended upward, above a top surface 136 of the female housing 100. FIG. 8 also shows that the button 102 is extended upward, above a top surface 136 of the female housing 100. As shown in FIG. 1, for example, the button 102 is held up or suspended in the extended and relaxed undeflected position by the latch beams 104 and 106.

As indicated above, after the connector latch of the present invention is manufactured, the connector latch is in the extended and relaxed undeflected position. The connector latch is then subjected to a pre-mating deflection process, in order to deflect the connector latch and lock the connector latch in a preloaded position.

After the pre-mating deflection process has been completed, the connector latch is locked in a preloaded position and can be referred to as a preloaded connector latch.

Figure 10:
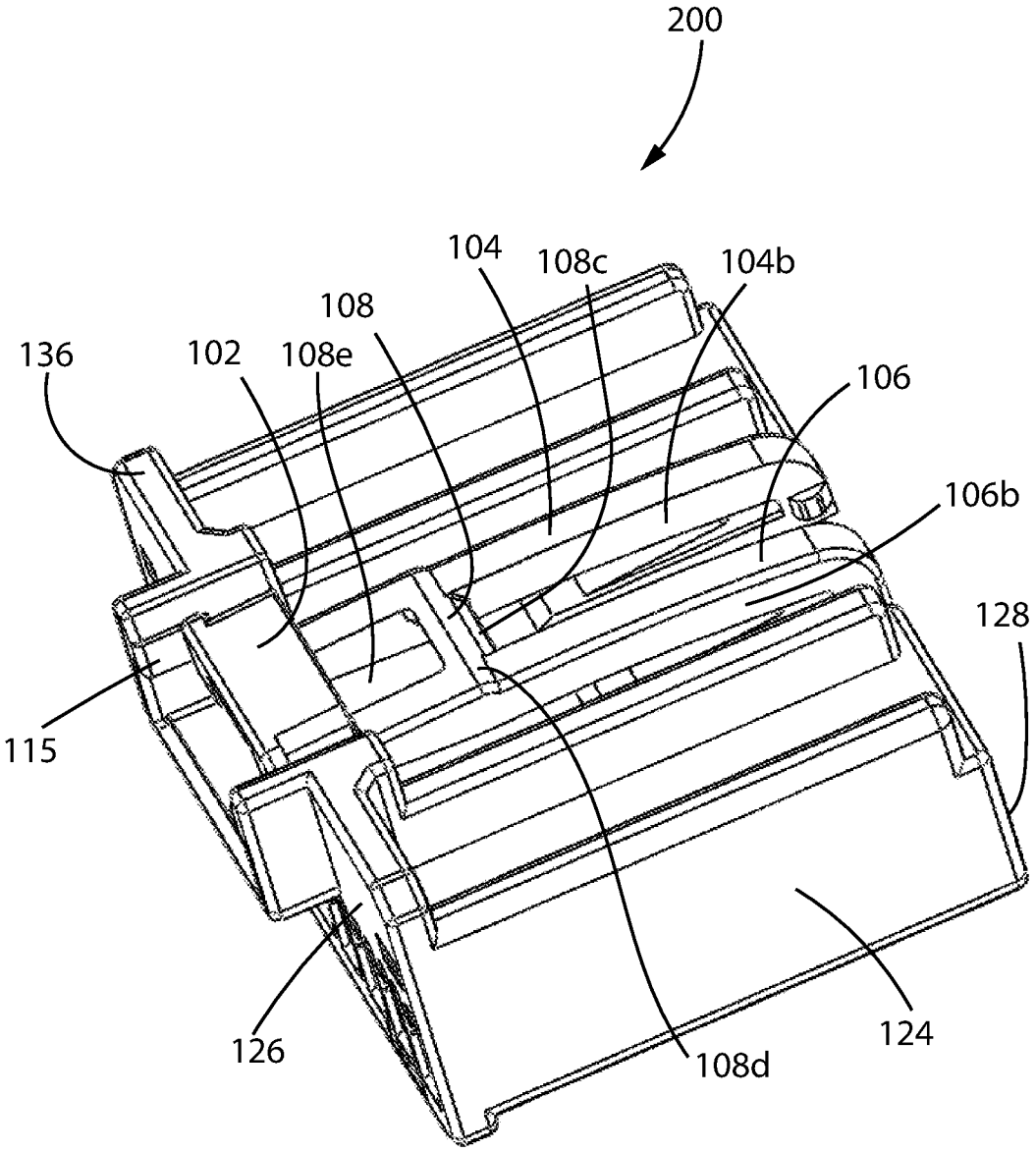
FIG. 10 is a first perspective view of a female housing having a connector latch in accordance with the principles of the present invention, showing the connector latch in a preloaded position, without a connector position assurance (CPA) unit shown.

FIG. 10 is a first perspective view of a female housing having a connector latch in accordance with the principles of the present invention, showing the connector latch in a preloaded position, without a connector position assurance (CPA) unit shown. Reference numeral 200 denotes a female housing having a connector latch in a preloaded position. FIG. 10 depicts a lower section 108*c* of the latch surface 108 of the connector latch, an upper section 108*d* of the latch surface 108 of the connector latch, and an aperture 108*e* formed by the connector latch.

Figure 11:
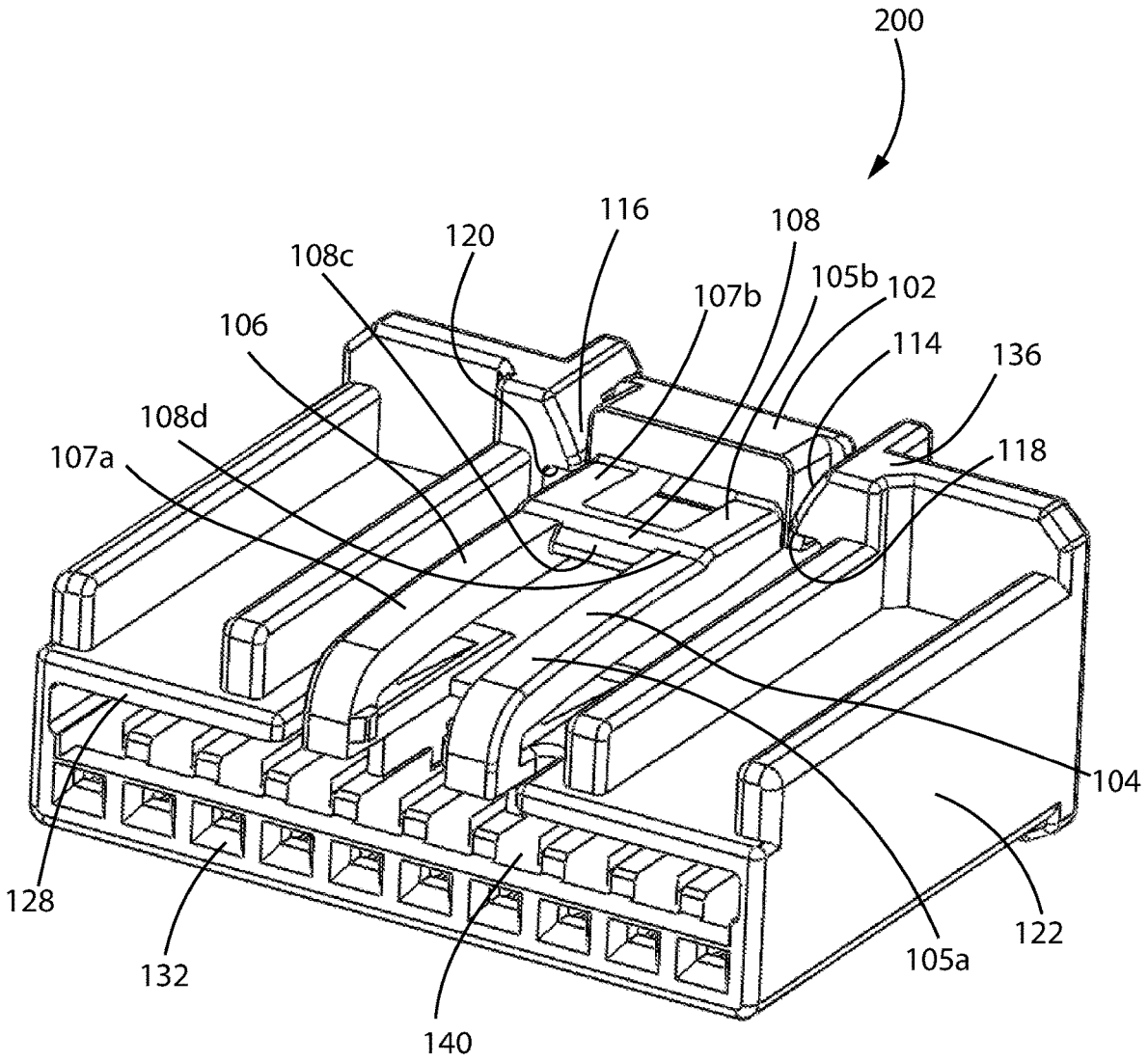
FIG. 11 is a second perspective view of the female housing shown in FIG. 10.
Figure 12:
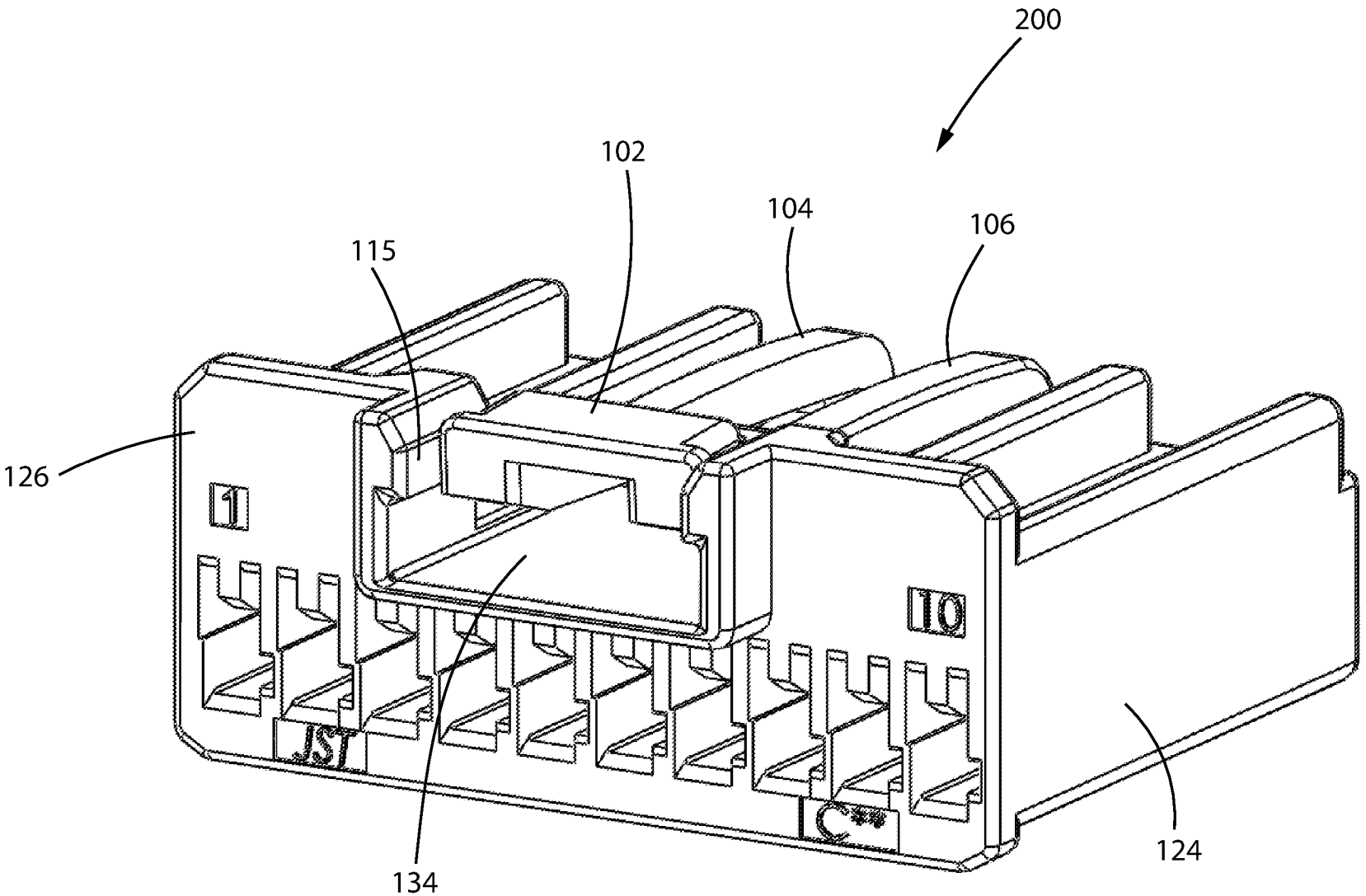
FIG. 12 is a third perspective view of the female housing shown in FIG. 10.

FIG. 11 is a second perspective view of the female housing shown in FIG. 10. FIG. 11 depicts a lower section 105*a* of the first latch beam 104, and an upper section 105*b* of the first latch beam 104. FIG. 12 is a third perspective view of the female housing shown in FIG. 10.

Figure 13A:
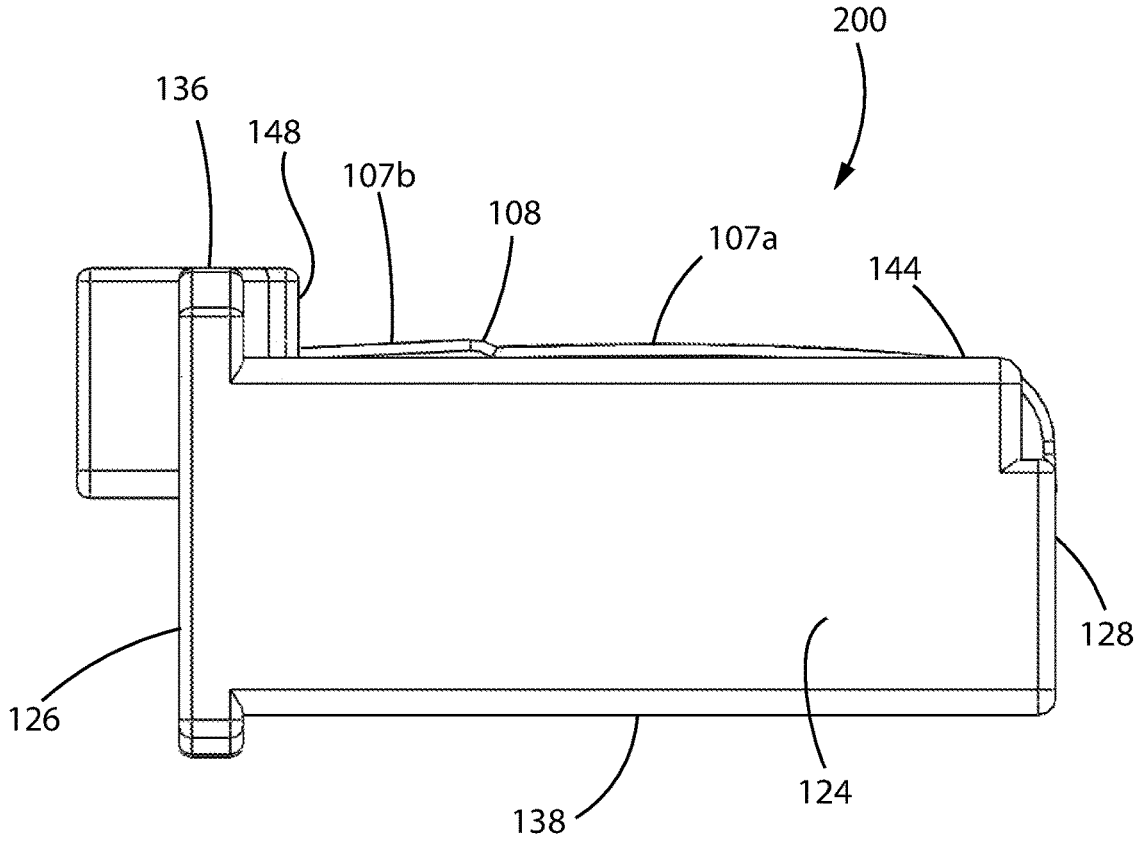
FIG. 13A is a side elevational view of the female housing shown in FIG. 10.
Figure 13B:
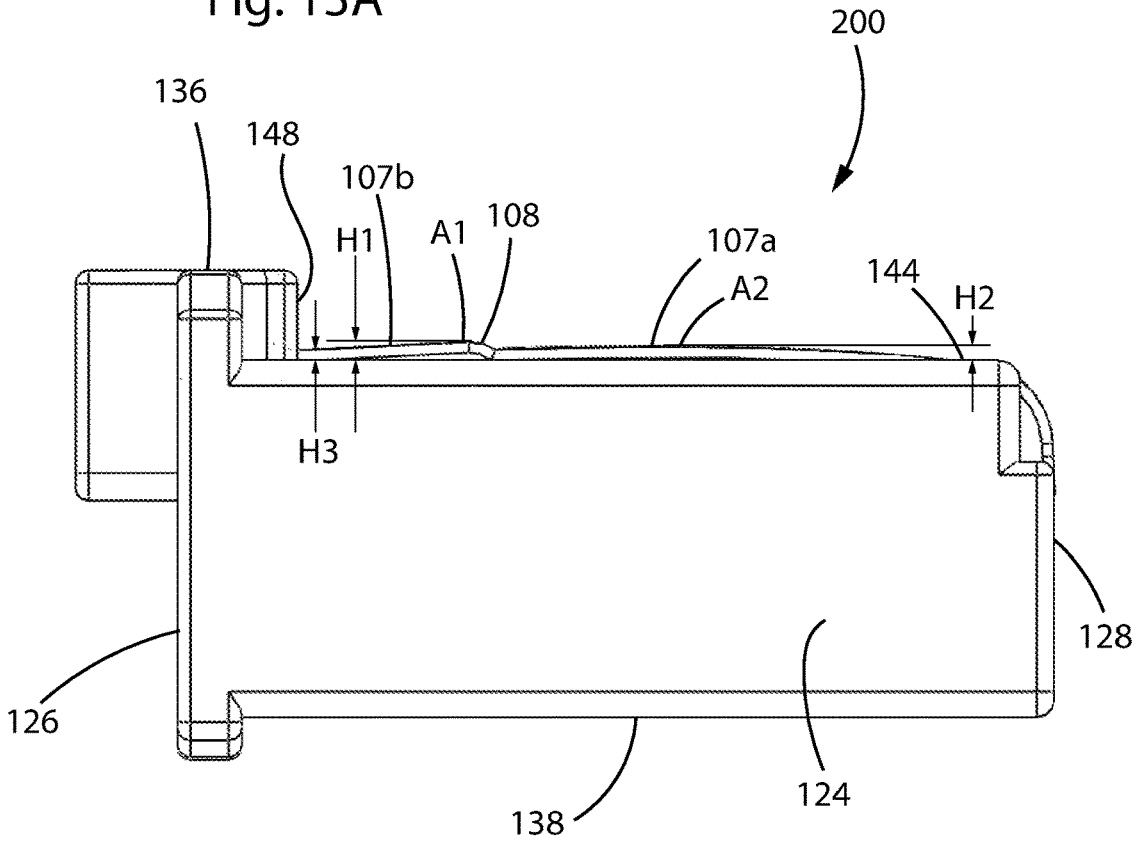
FIG. 13B is a side elevational view of the female housing shown in FIG. 10, with additional information.

FIG. 13A is a side elevational view of the female housing shown in FIG. 10. FIG. 13B is a side elevational view of the female housing shown in FIG. 10, with additional information.

FIGS. 13A and 13B depict the same structural configuration, wherein the female housing 200 has the connector latch in a preloaded position. However, FIG. 13B includes additional information regarding a location A1, a location A2, a height H1, a height H2, and a height H3.

The location A1 represents the highest point of the upper section 107*b* of the second latch beam 106, when the connector latch is in a preloaded position. The location A2 represents the highest point of the lower section 107*a* of the second latch beam 106, when the connector latch is in a preloaded position.

The height H1 is the vertical distance upward from the top surface of the first rib 144 to the location A1, when the connector latch is in a preloaded position. The height H2 is the vertical distance upward from the top surface of the first rib 144 to the location A2, when the connector latch is in a preloaded position. The height H3 is the vertical distance upward from the top surface of the first rib 144 to the top surface of the upper section 107*b* of the second latch beam 106, at a location near to the rear surface 148 of the front wall on a second side of the female housing 200, when the connector latch is in a preloaded position. The height H1 is greater than the height H2. The height H2 is greater than the height H3.

As shown in FIGS. 13A and 13B, the second latch beam 106 has a curved shape when the connector latch is in a preloaded position. The upper surface of the lower section 107*a* curves upward from the rear 128 of the female housing 200 toward the location A2, and then curves downward from the location A2 toward the latch surface 108. The upper surface of the latch surface 108 curves upward from the lower section 107*a* toward the upper section 107*b*. The upper surface of the upper section 107*b* curves downward from the location A1 toward the rear surface 148 of the front wall on a second side of the female housing 200.

The above-noted curvatures, shown in FIGS. 13A and 13B, indicate that the latch beams 104 and 106 are under a high level of stress while in the preloaded position. The button 102 is forced to be in a very low position causing the curving or bending of the latch beams 104 and 106, because of the locations and structural configurations of the surfaces 110, 112, 118, and 120. The above-noted curvatures and related features help to cause a load "click" sound during mating.

The lower section 107*a* of the second latch beam 106 is not curved when the connector latch is in an undeflected position, and the upper section 107*b* of the second latch beam 106 is not curved when the connector latch is in an undeflected position (see FIGS. 1-9).

The lower section 105*a* of the first latch beam 104 is not curved when the connector latch is in an undeflected position, and the upper section 105*b* of the first latch beam 104 is not curved when the connector latch is in an undeflected position (see FIGS. 1-9).

The lower section 107*a* of the second latch beam 106 is curved when the connector latch is in a preloaded position (see FIGS. 10-17). The lower section 105*a* of the first latch beam 104 is curved when the connector latch is in a preloaded position (see FIGS. 10-17).

The aperture 108*e*, or a space, is formed between sections 105*b* and 107*b*. Also, a space is formed between sections 105*a* and 107*a*.

Figure 14:
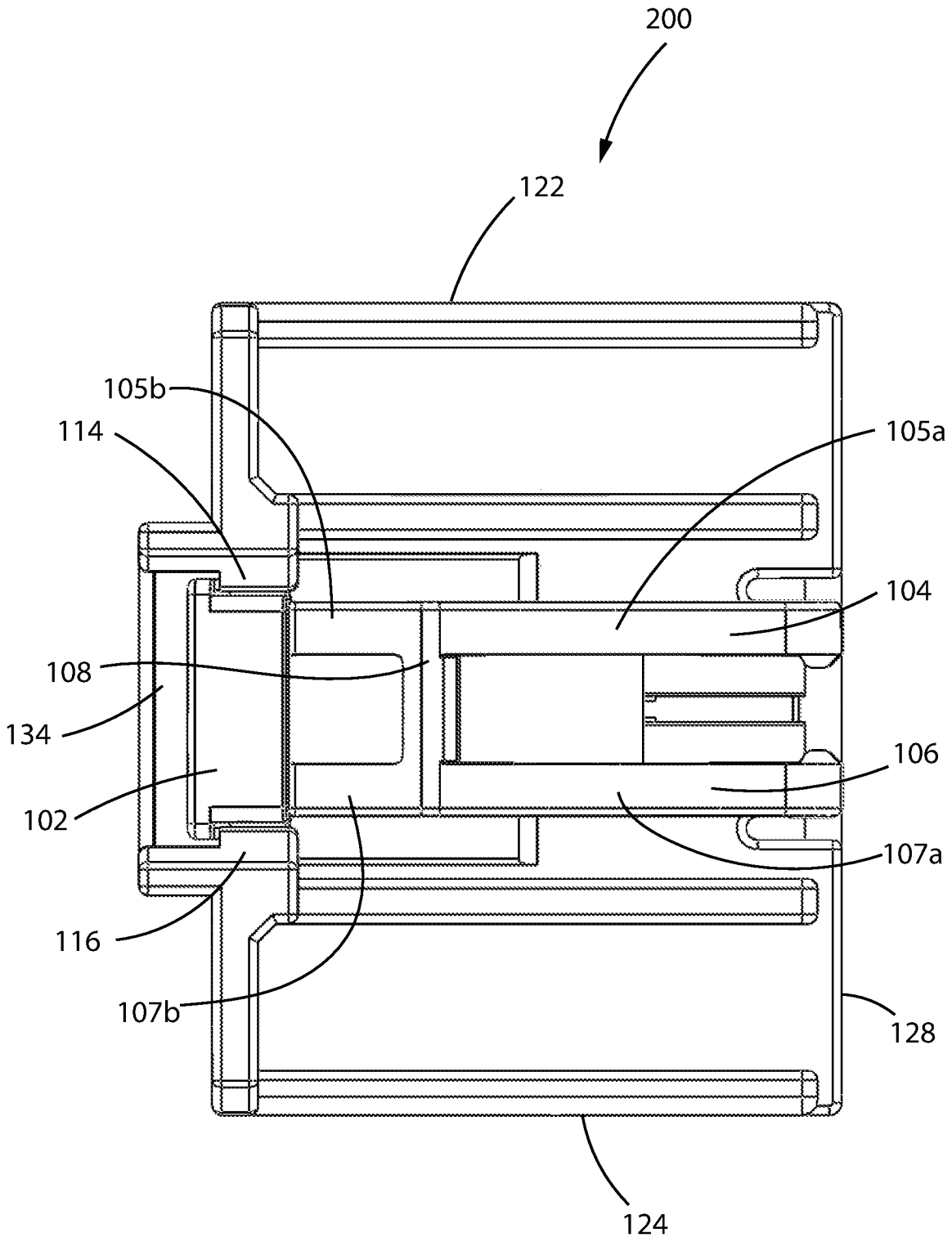
FIG. 14 is a top elevational view of the female housing shown in FIG. 10.
Figure 15:
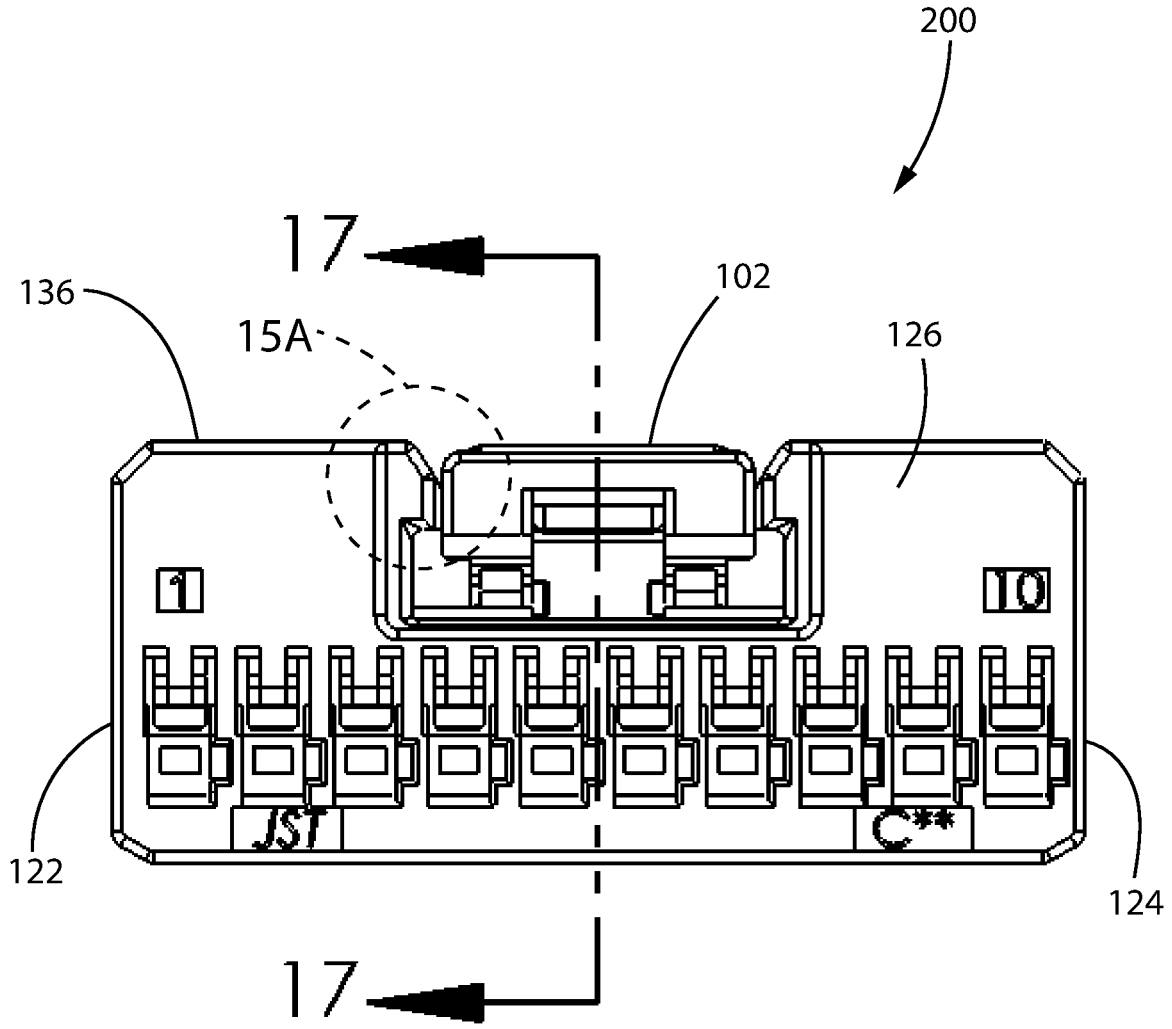
FIG. 15 is a front end elevational view of the female housing shown in FIG. 10.
Figure 15A:
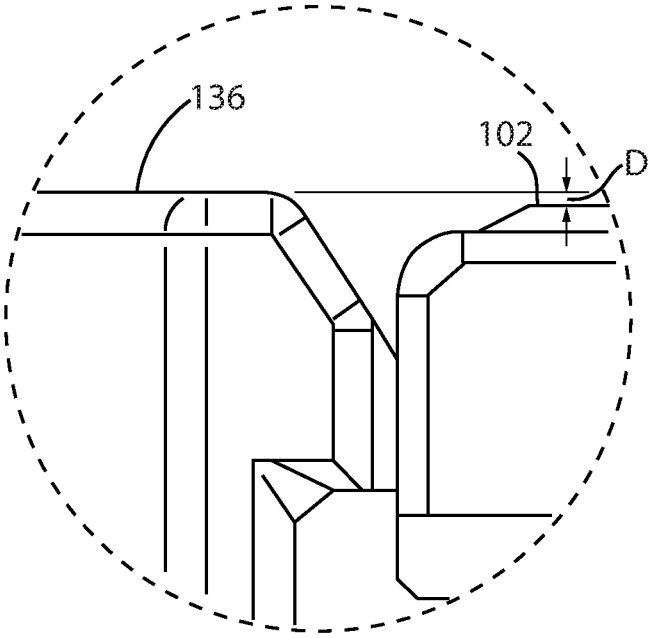
FIG. 15A is an enlarged view of portion 15A in FIG. 15.

FIG. 14 is a top elevational view of the female housing shown in FIG. 10. FIG. 15 is a front end elevational view of the female housing shown in FIG. 10. FIG. 15A is an enlarged view of portion 15A in FIG. 15. FIG. 15A shows that the upper surface of the button 102 is below the top 136 when the connector latch is in a preloaded position. The distance D is measured from the upper surface of the button 102 to the upper surface of the top 136 of the female housing 200, when the connector latch is in a preloaded position.

The fact that the upper surface of the button 102 is below the upper surface of the top 136, when the connector latch is in a preloaded position, indicates that the latch beams 104 and 106 are under a high level of stress while in the preloaded position. The button 102 is forced to be in a very low position due to the locations and structural configurations of the surfaces 110, 112, 118, and 120. The above-noted features, regarding the relative positions of the button 102 and the top 136 when the connector latch is in a preloaded position, help to cause a load "click" sound during mating.

Figure 16:
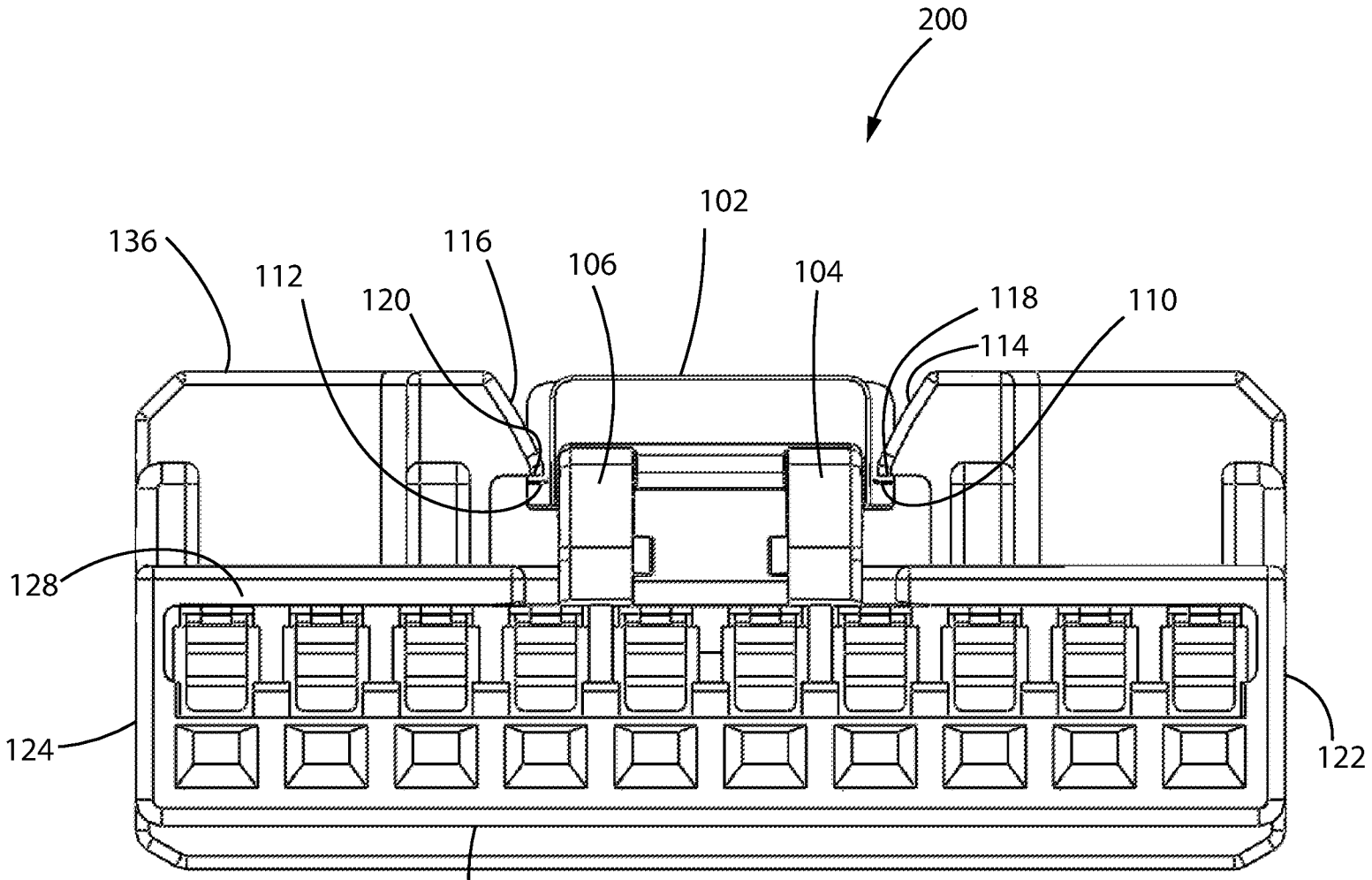
FIG. 16 is a rear end elevational view of the female housing shown in FIG. 10.
Figure 17:
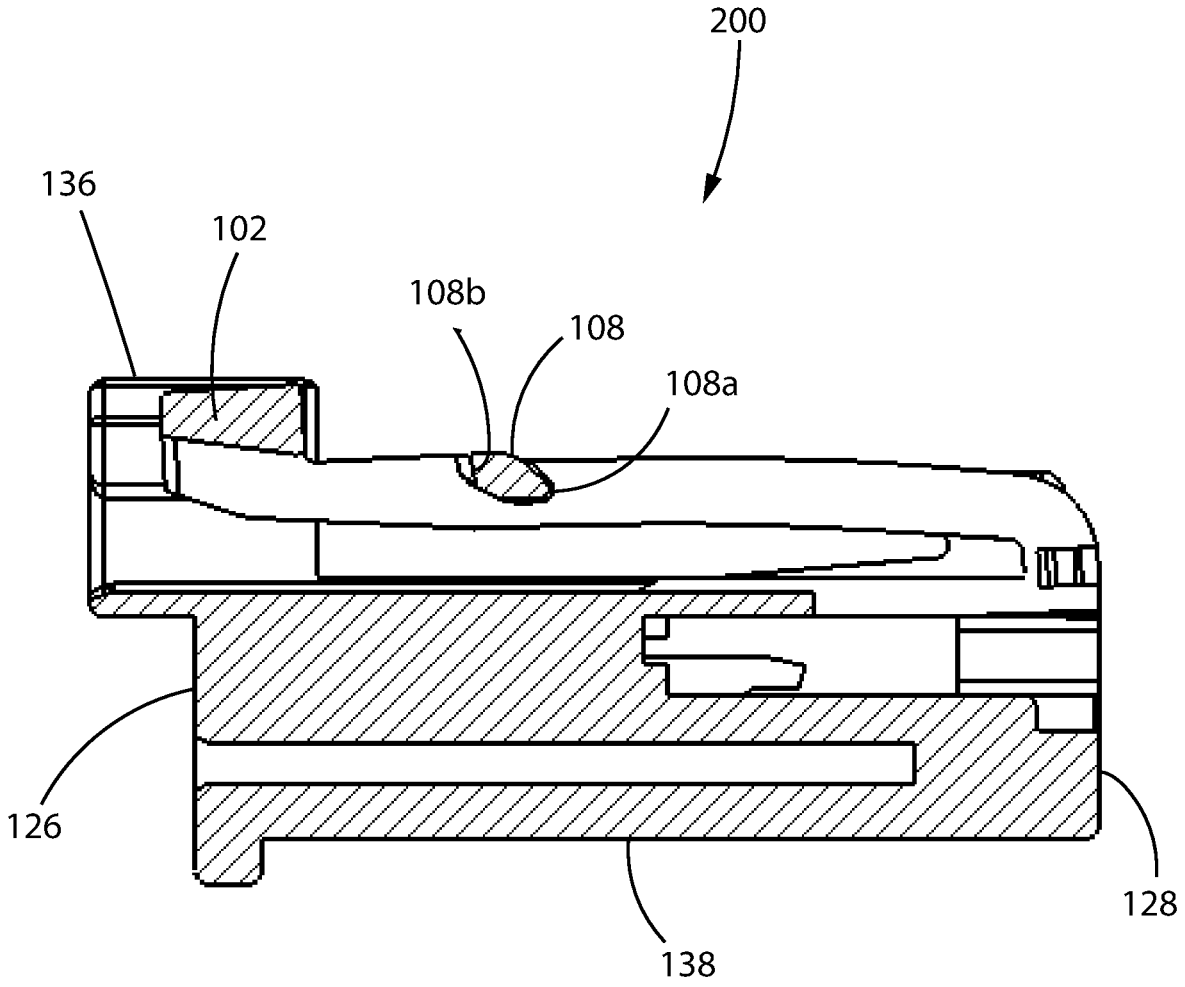
FIG. 17 is a cross-sectional view, taken along line 17-17 in FIG. 15, of the female housing.

FIG. 16 is a rear end elevational view of the female housing shown in FIG. 10. FIG. 17 is a cross-sectional view, taken along line 17-17 in FIG. 15, of the female housing. FIG. 17 depicts a front edge 108*a* of the latch surface 108, and also depicts a rear edge 108*b* of the latch surface 108.

FIGS. 10-17 show the connector latch in a preloaded position. As shown in FIGS. 10-17, when the connector latch is in a preloaded position, the top surface of the button 102 is not extended upward above the top surface 136 of the female housing 200. When the connector latch is in a preloaded position, the top surface of the button 102 is not at the same level as the top surface 136 of the female housing 200. When the connector latch is in a preloaded position, the top surface of the button 102 is below the top surface 136 by a distance D, as shown in FIG. 15A.

A pre-mating deflection process is utilized to move the button 102 of the connector latch down from the undeflected position (shown in FIGS. 1-9) to the preloaded position (shown in FIGS. 10-17), and thereby lock the connector latch in a preloaded position.

When a pre-mating deflection process is performed, the button 102 is moved downward toward the bottom surface 138 of the female housing, and latch beams 104 and 106 are deflected.

When the connector latch is locked in a preloaded position, the first overstress protection surface 110 on the button 102 is engaged with the first overstress protection surface 118 on the first frame 114 of the female housing 200, and the second overstress protection surface 112 on the button 102 is engaged with the second overstress protection surface 120 on the second frame 116 of the female housing 200. Please see FIG. 16.

Figure 18:
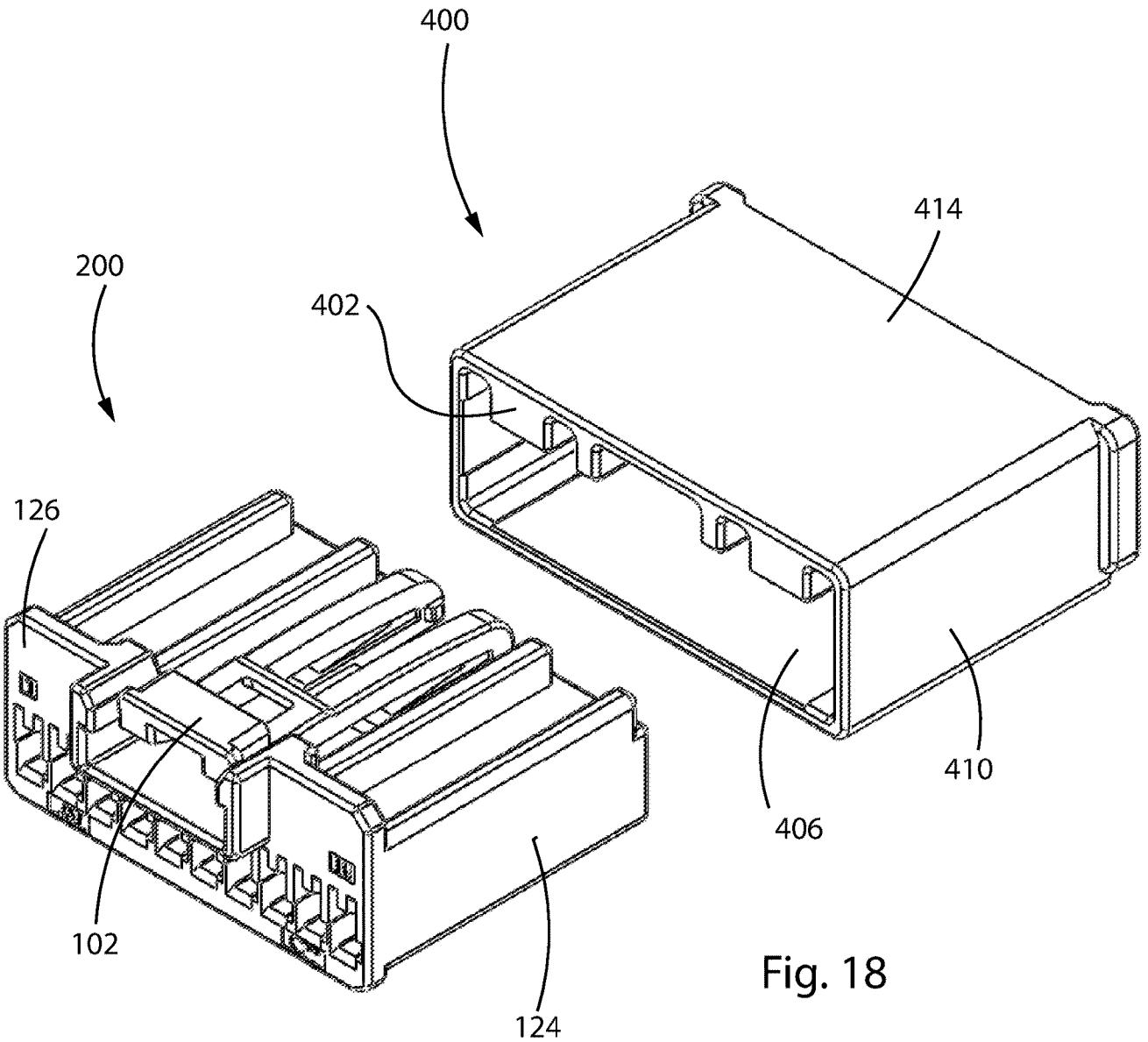
FIG. 18 is an exploded perspective view of a female housing and a male housing, depicting step one of a three-step mating process, wherein the female housing has a connector latch in accordance with the principles of the present invention, showing the connector latch in a preloaded position, without a connector position assurance (CPA) unit shown.

FIG. 18 is an exploded perspective view of a female housing and a male housing, depicting step one of a three-step mating process, wherein the female housing has a connector latch in accordance with the principles of the present invention, showing the connector latch in a preloaded position. FIG. 18 does not show a connector position assurance (CPA) unit.

FIG. 18 illustrates a connector apparatus, wherein the connector apparatus has at least a female housing 200 and a male housing 400 which can be mated together. FIG. 18 depicts a front 402 of the male housing 400, an aperture 406 for receiving the rear 128 of the female housing 200, a second side 410 of the male housing 400, and a top 414 of the male housing 400.

Figure 19:
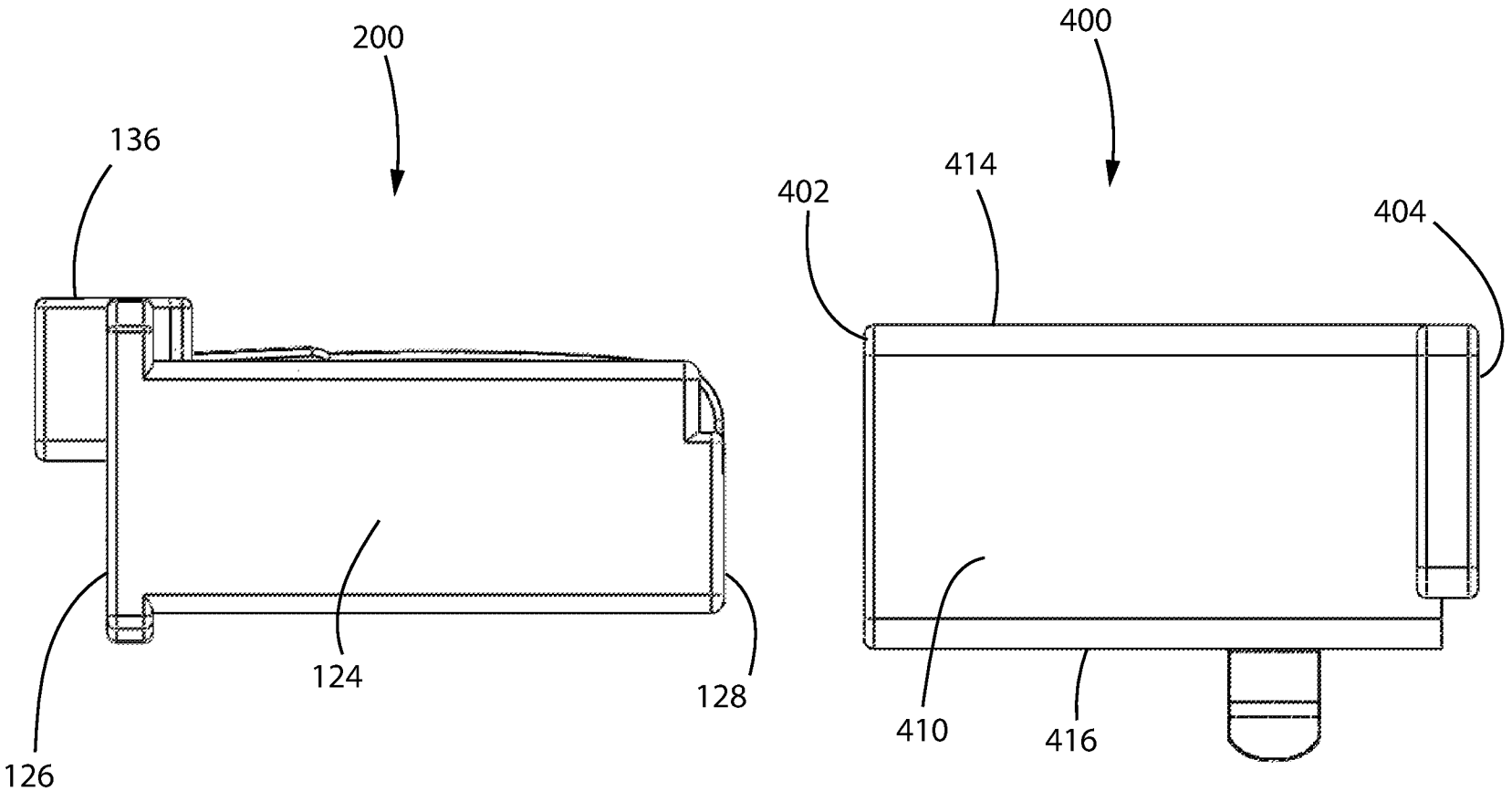
FIG. 19 is a side elevational view of the configuration shown in FIG. 18.
Figure 20:
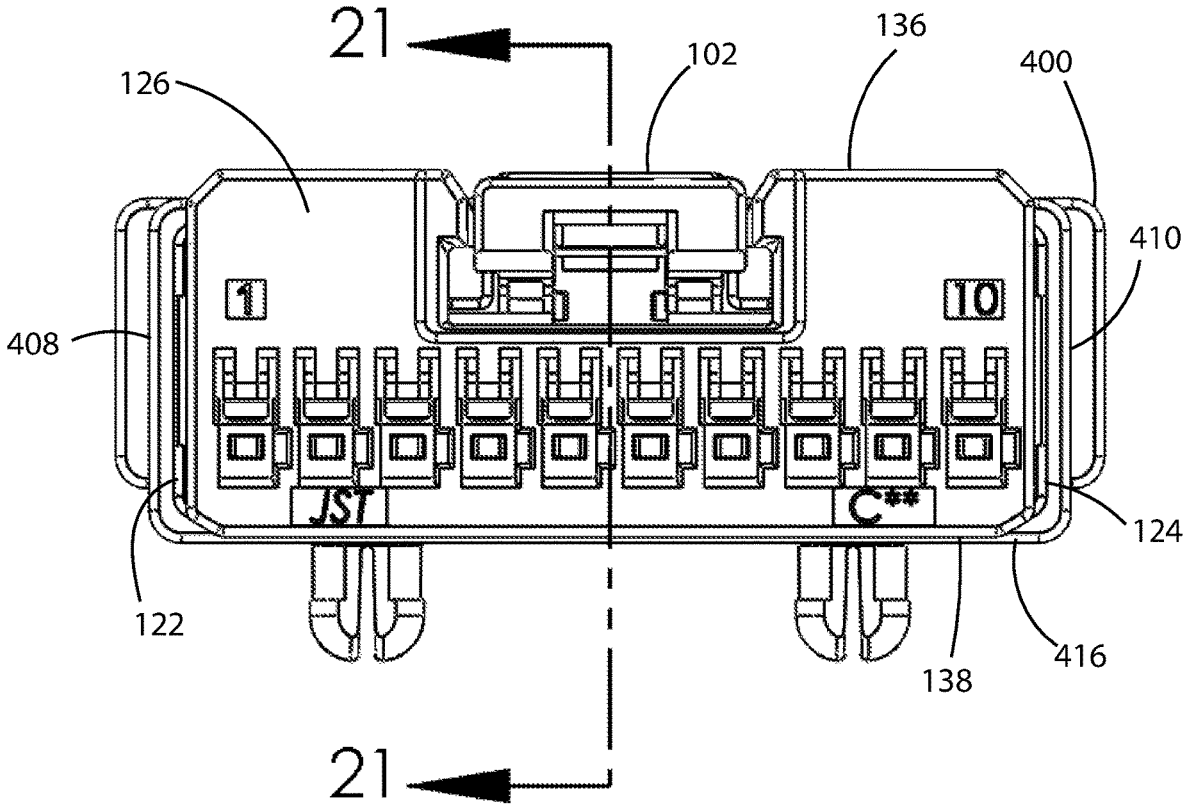
FIG. 20 is a front end elevational view of the configuration shown in FIG. 18.

FIG. 19 is a side elevational view of the configuration shown in FIG. 18. FIG. 19 shows that the male housing 400 has a rear 404 and a bottom 416. FIG. 20 is a front end elevational view of the configuration shown in FIG. 18. Reference numeral 408 denotes a first side of the male housing 400.

Figure 21:
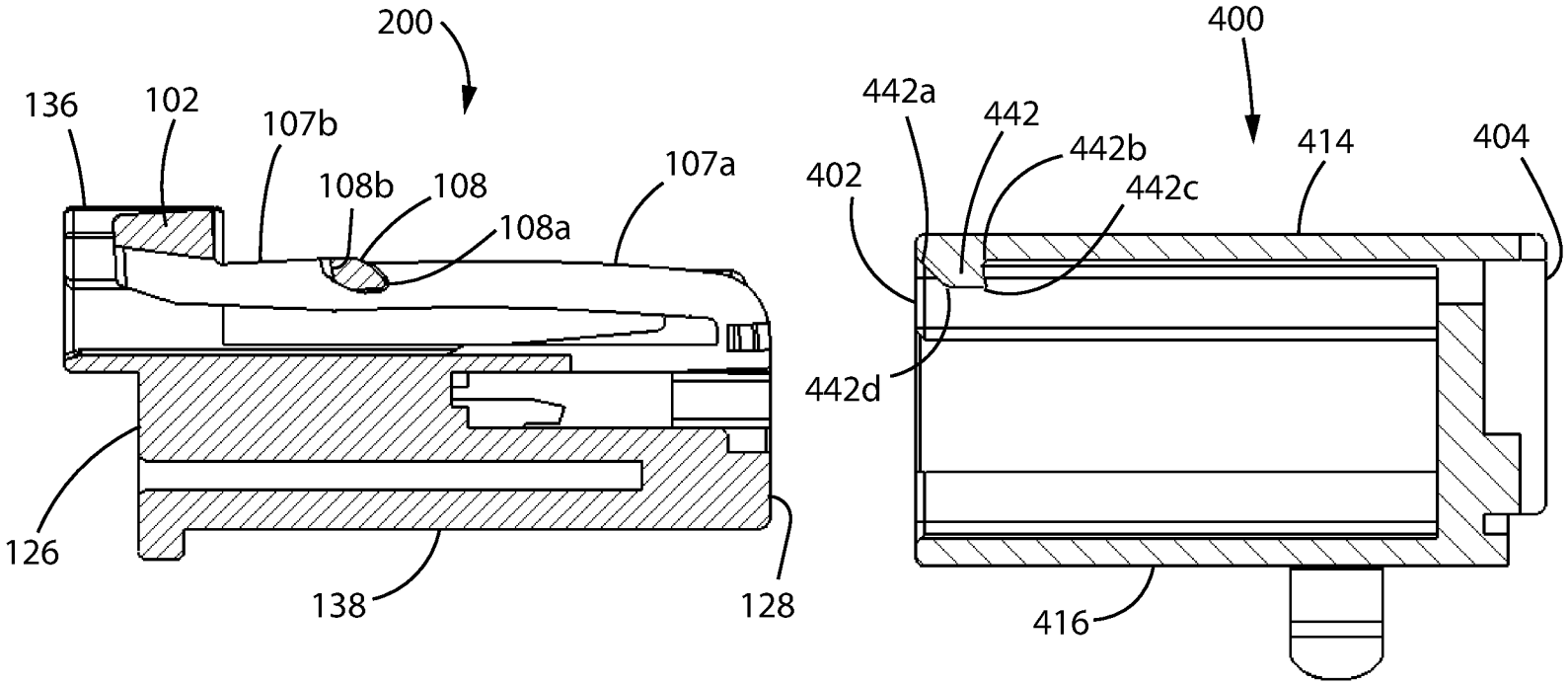
FIG. 21 is a cross-sectional view, taken along line 21-21 in FIG. 20.

FIG. 21 is a cross-sectional view, taken along line 21-21 in FIG. 20. FIG. 21 shows a first embodiment of a protrusion 442 formed by the male housing 400. The protrusion 442 may also be referred to as a shark fin 442. The protrusion 442 has a front upper point 442*a*, a rear upper point 442*b*, a rear lower point 442*c*, and a front lower point 442*d*.

As shown in FIGS. 18-21, the protrusion 442 of the male housing 400 has not yet engaged the latch surface 108 of the connector latch on the female housing 200.

As shown in FIGS. 18-21, the connector latch of the female housing 200 is in a preloaded position. The protrusion 442 has not yet contacted the latch surface 108 of the female housing 200, as shown in FIG. 21. The upper surface of the button 102 is below the top surface 136 of the female housing 200, as shown in FIG. 21.

Figure 22:
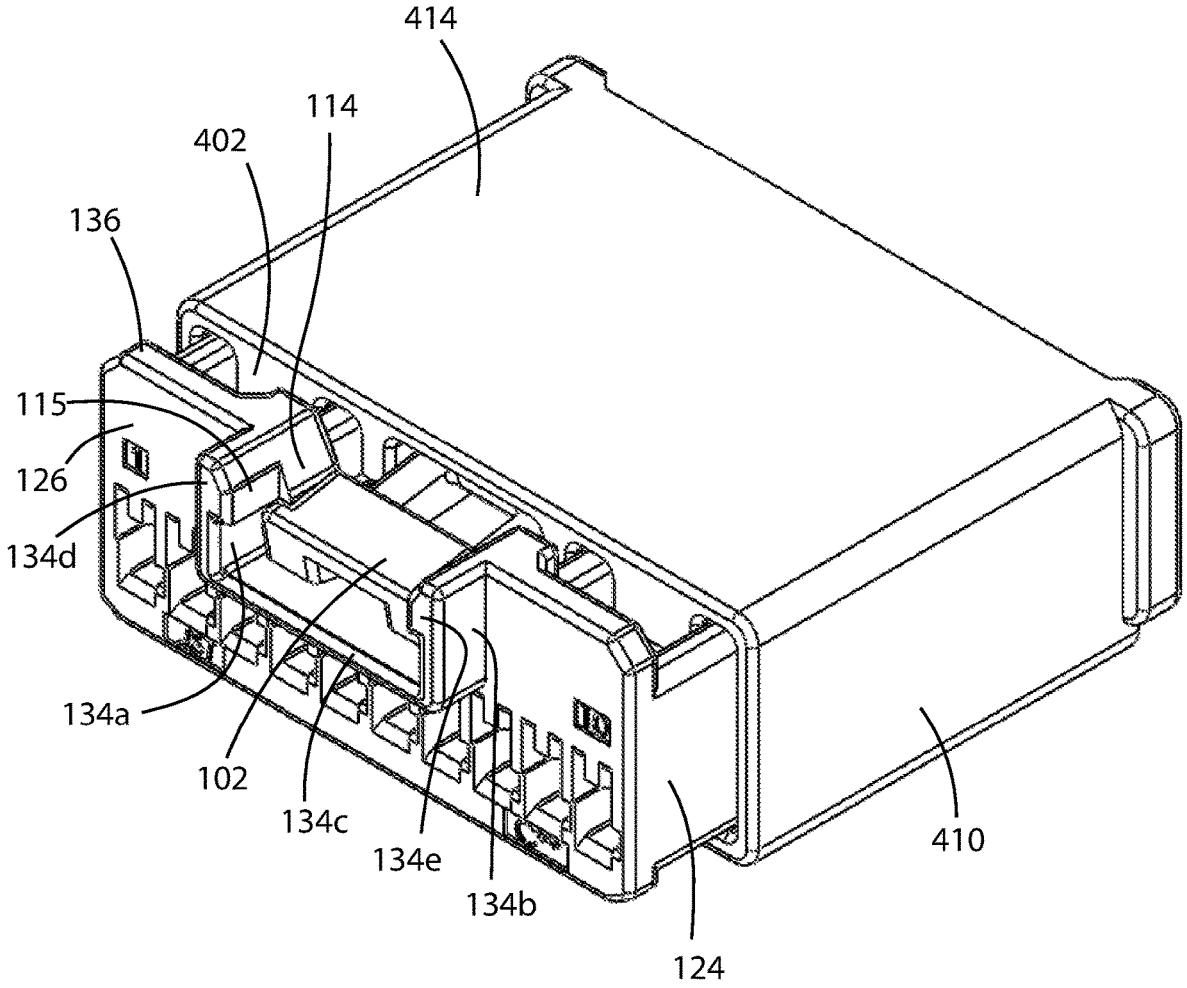
FIG. 22 is a perspective view of a female housing and a male housing, depicting step two of a three-step mating process, wherein the female housing has a connector latch in accordance with the principles of the present invention, without a connector position assurance (CPA) unit shown.

FIG. 22 is a perspective view of a female housing and a male housing, depicting step two of a three-step mating process, wherein the female housing has a connector latch in accordance with the principles of the present invention. FIG. 22 does not show a connector position assurance (CPA) unit.

FIG. 22 depicts a first side wall 134*a* of the aperture 134, a second side wall 134*b* of the aperture 134, a wall 134*c* of the aperture 134 which is at a lower side of the aperture 134, a front edge 134*d* of the first side wall 134*a*, and a front edge 134*e* of the second side wall 134*b*. As shown in FIG. 22, the first interior side wall 115 extends from the first frame 114 to the front edge 134*d*.

Figure 23:
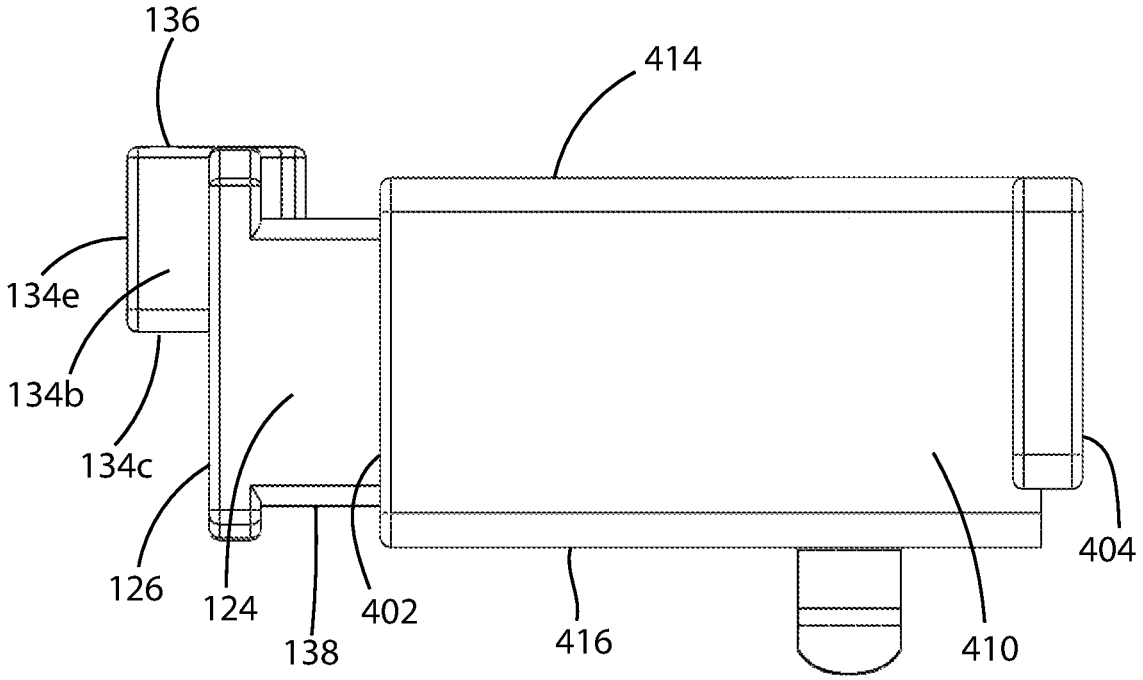
FIG. 23 is a side elevational view of the configuration shown in FIG. 22.
Figure 24:
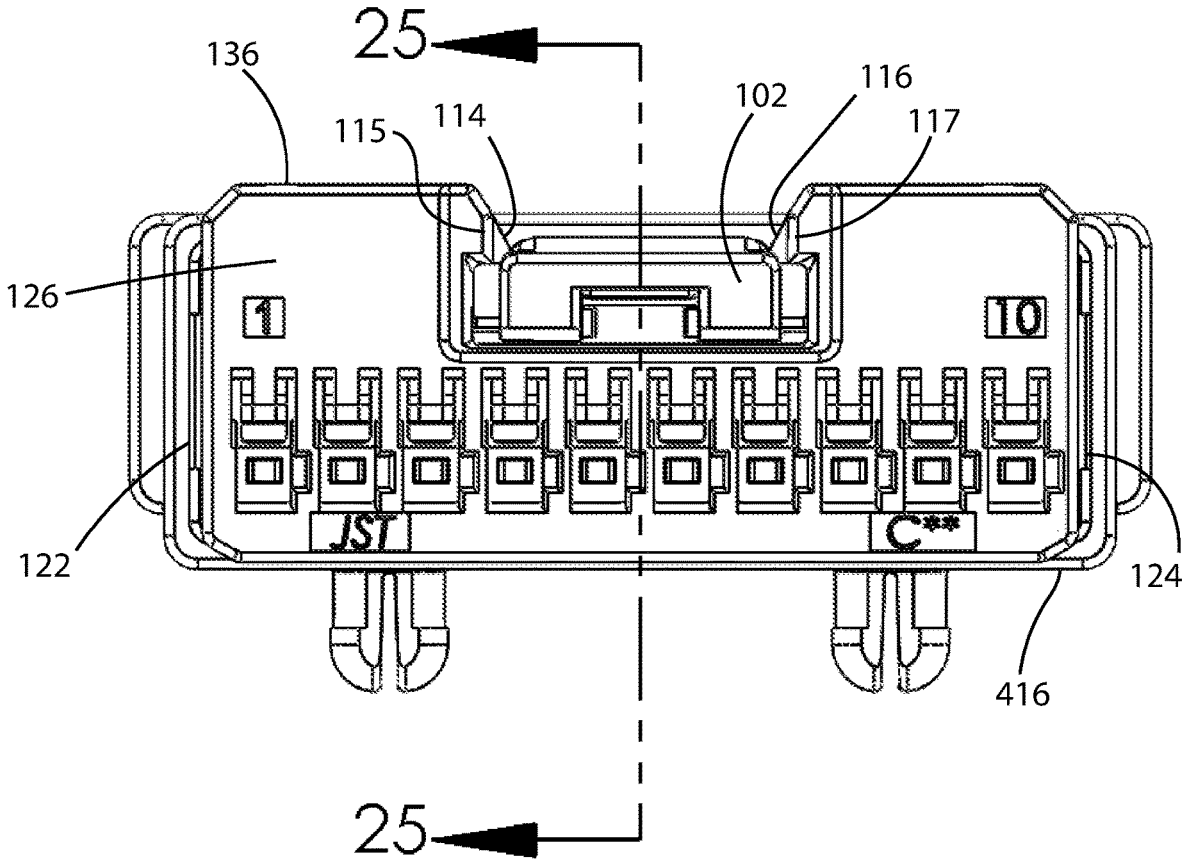
FIG. 24 is a front end elevational view of the configuration shown in FIG. 22.

FIG. 23 is a side elevational view of the configuration shown in FIG. 22. FIG. 24 is a front end elevational view of the configuration shown in FIG. 22.

Figure 25:
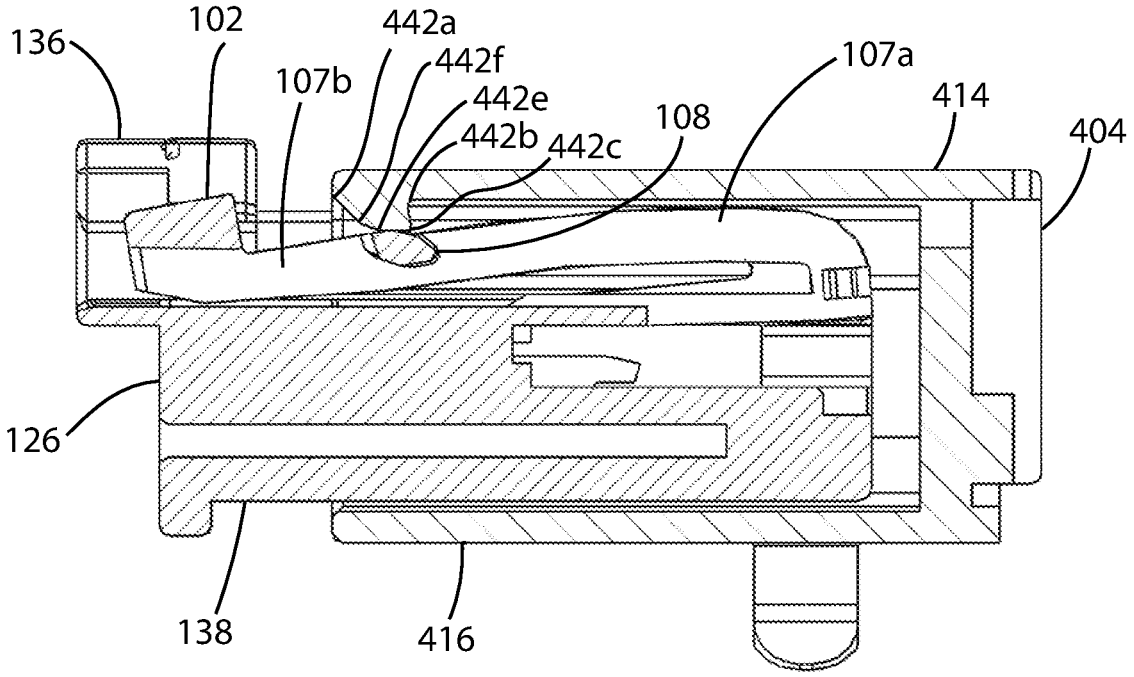
FIG. 25 is a cross-sectional view, taken along line 25-25 in FIG. 24.

FIG. 25 is a cross-sectional view, taken along line 25-25 in FIG. 24. FIG. 25 shows a second embodiment of the protrusion 442 formed by the male housing 400. As shown in FIG. 25, the protrusion 442 has a front upper point 442*a*, a rear upper point 442*b*, a rear lower point 442*c*, a front lower point 442*e*, and a front mid-range point 442*f*.

As shown in FIGS. 22-25, the protrusion 442 of the male housing 400 is engaging the latch surface 108 of the connector latch on the female housing 200. Because the protrusion 442 of the male housing 400 engages the latch surface 108 of the connector latch on the female housing 200, as shown in FIGS. 22-25, in step two of the three-step mating process, the button 102 is moved downward toward the bottom surface 138 of the female housing 200, and latch beams 104 and 106 are deflected.

As shown in FIGS. 22-25, the connector latch of the female housing 200 is not in the undeflected position, and the connector latch of the female housing 200 is not in the preloaded position. The connector latch of the female housing 200 is in a transitional position, as shown in FIGS. 22-25. The protrusion 442 is contacting the latch surface 108, is positioned above the latch surface 108, and is pushing the latch surface 108 downward toward the bottom 138 of the female housing 200, as shown in FIGS. 22-25.

FIG. 7 shows that the top surface of the button 102 is above the top surface 136 of the female housing 100, when the connector latch is in an undeflected position. FIGS. 15 and 15A show that the top surface of the button 102 is the distance D below the top surface 136 of the female housing 200 when the connector latch is in a preloaded position. FIGS. 24 and 25 show that a top surface of the button 102 is below the top surface 136 of the female housing 200, by more than the distance D, when the connector latch of the female housing 200 is in a transitional position.

As shown in FIG. 24, a top surface of the button 102 is well below the top surface 136 of a female housing 200 because protrusion 442 is engaging the latch surface 108. FIG. 25 shows that the protrusion 442 is engaging the latch surface 108.

Figure 26:
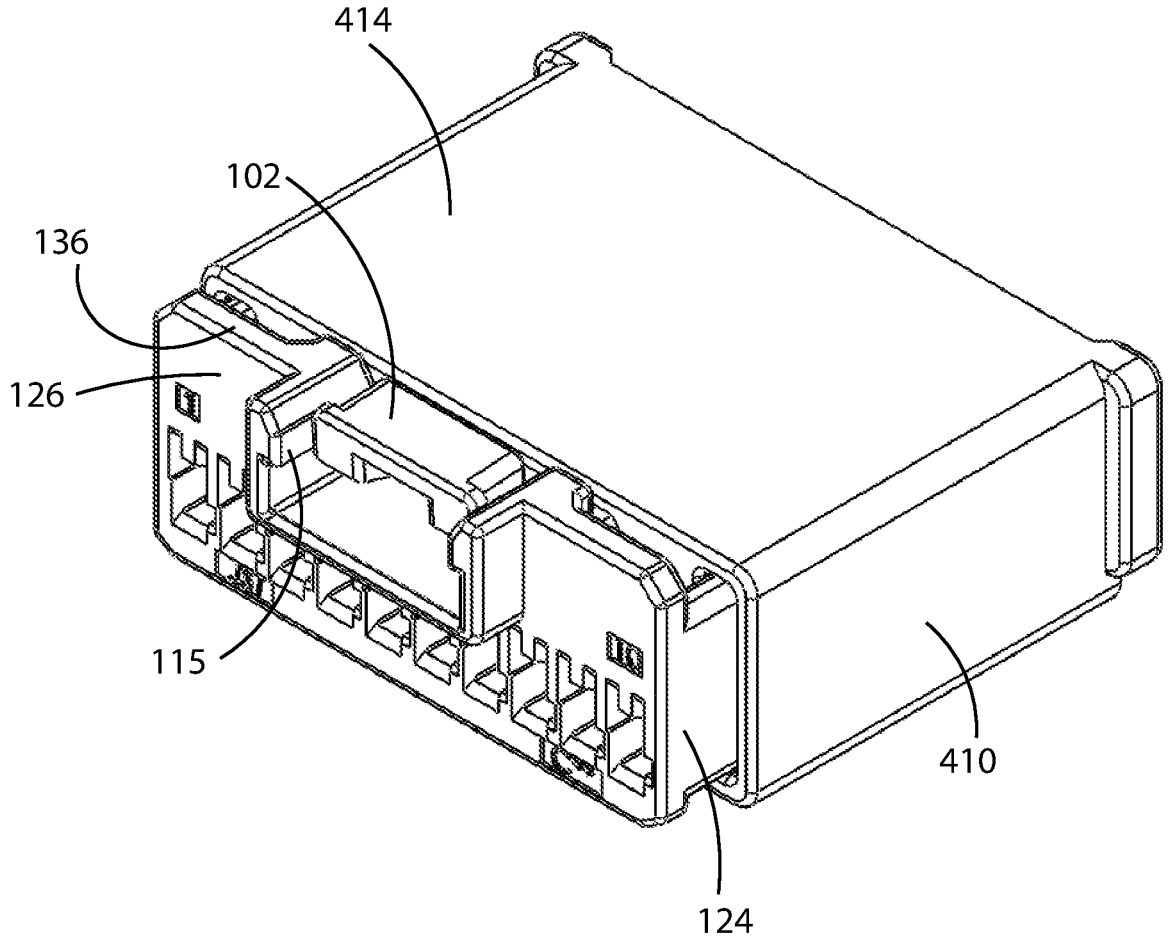
FIG. 26 is a perspective view of a female housing and a male housing, depicting step three of a three-step mating process, wherein the female housing has a connector latch in accordance with the principles of the present invention, without a connector position assurance (CPA) unit shown.

FIG. 26 is a perspective view of a female housing and a male housing, depicting step three of a three-step mating process, wherein the female housing has a connector latch in accordance with the principles of the present invention. FIG. 26 does not show a connector position assurance (CPA) unit.

Figure 27:
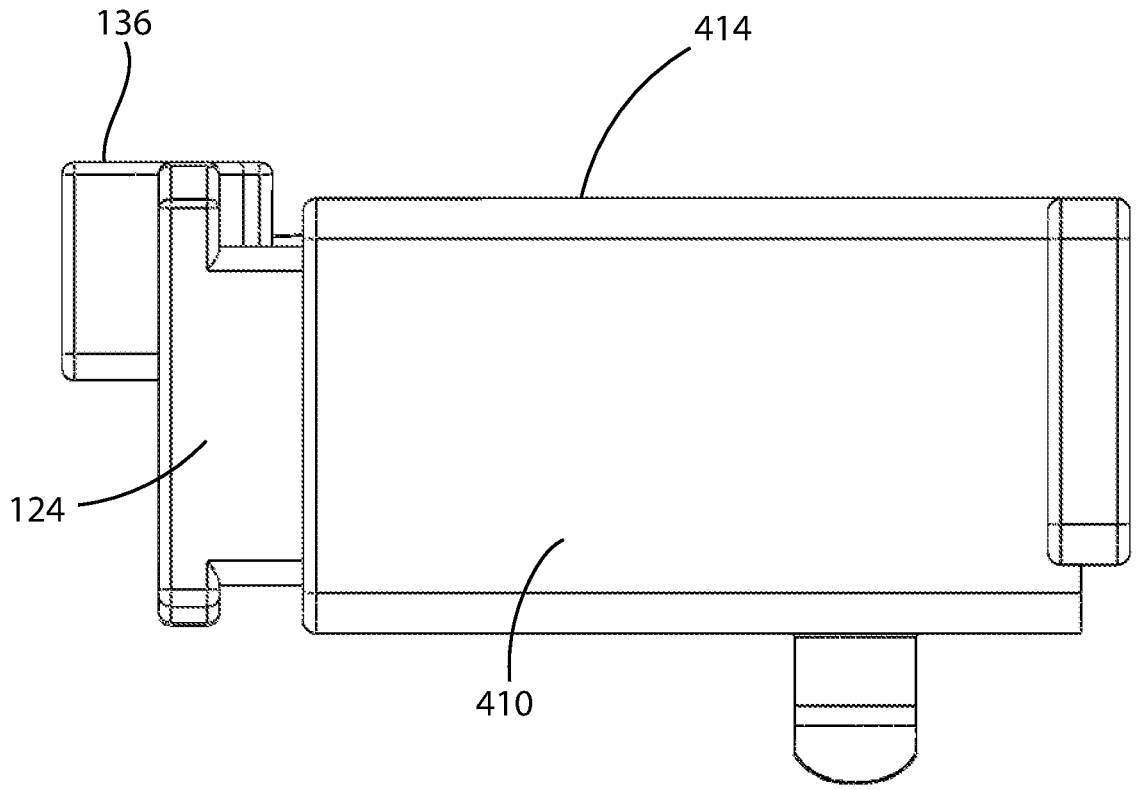
FIG. 27 is a side elevational view of the configuration shown in FIG. 26.
Figure 28:
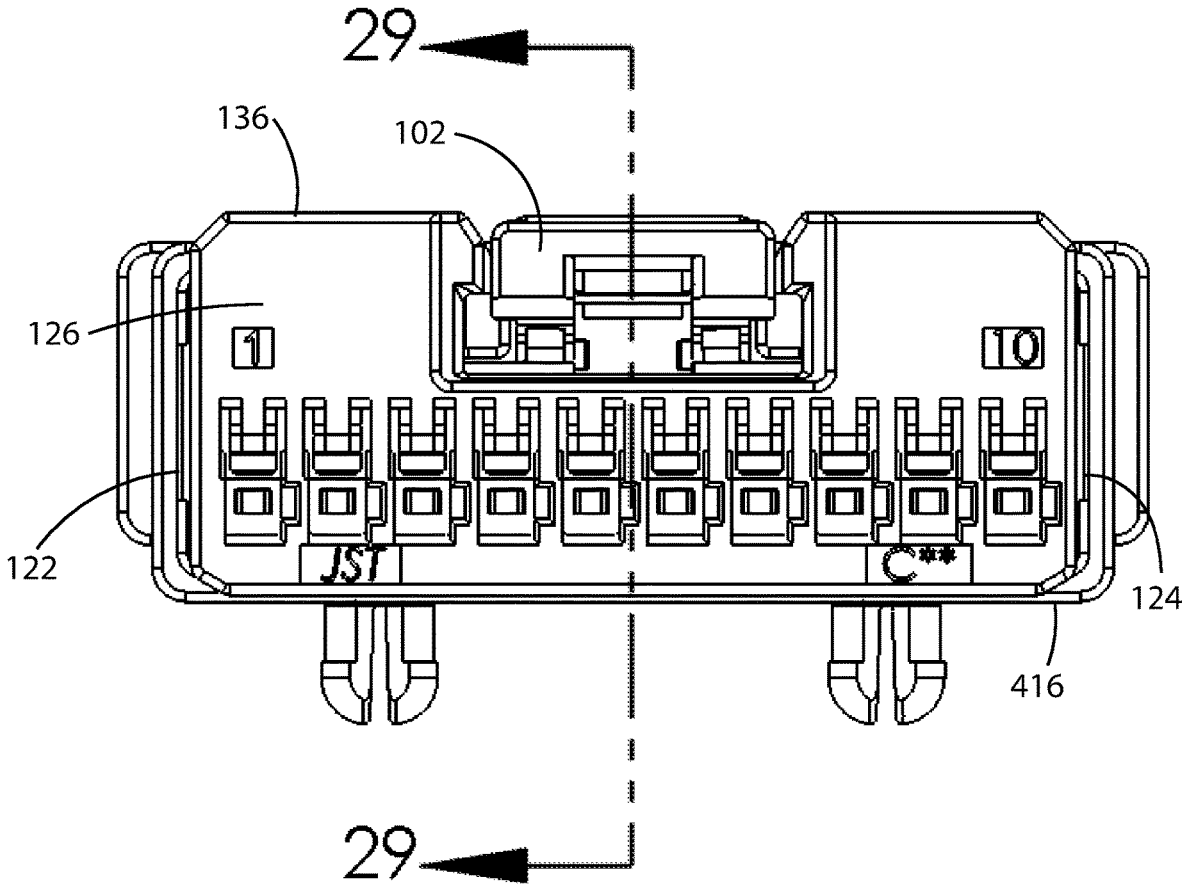
FIG. 28 is a front end elevational view of the configuration shown in FIG. 26.
Figure 29:
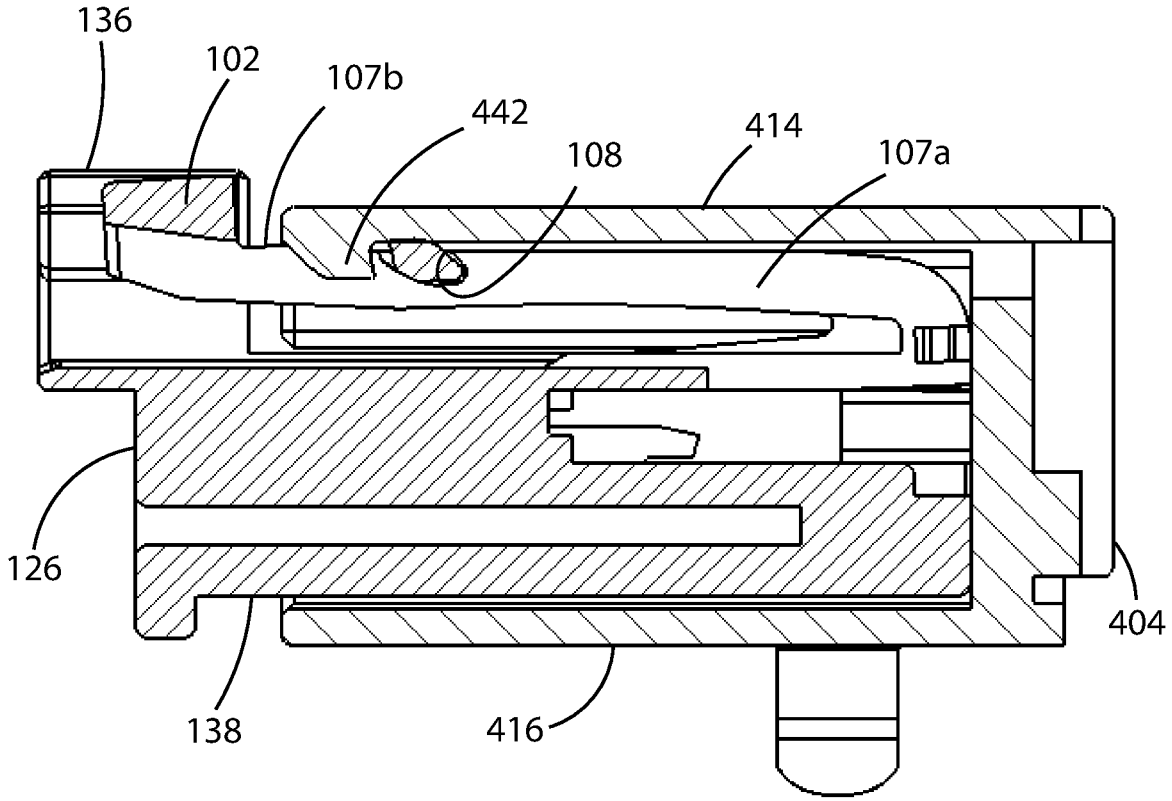
FIG. 29 is a cross-sectional view, taken along line 29-29 in FIG. 28.

FIG. 27 is a side elevational view of the configuration shown in FIG. 26. FIG. 28 is a front end elevational view of the configuration shown in FIG. 26. FIG. 29 is a cross-sectional view, taken along line 29-29 in FIG. 28.

As shown in FIGS. 26-29, the connector latch of the female housing 200 is in a preloaded position. The protrusion 442 is between the front 126 of the female housing 200 and the latch surface 108 of the female housing 200, as shown in FIG. 29. In FIG. 29, the connector latch is in a preloaded position, and the top surface of the button 102 is below the top surface 136 of the female housing 200 by a distance D. The distance D is shown in FIG. 15A. The position of the protrusion 442, in relation to the position of the latch surface 108, holds the female housing 200 to the male housing 400.

The aperture 108*e* is shown in FIG. 10A, and can also be referred to as a locking aperture 108*e*. The locking aperture 108*e* is formed by the following four components: the button 102; the upper section 105*b* of the first latch beam 104; the latch surface 108; and the upper section 107*b* of the second latch beam 106 (see FIGS. 1, 10, and 11). Thus, the locking aperture 108*e* is an orifice that has four sides, such that one side corresponds to a part of the button 102, one side corresponds to a part of the upper section 105*b* of the first latch beam 104, one side corresponds to a part of the latch surface 108, and one side corresponds to a part of the upper section 107*b* of the second latch beam 106. The protrusion 442 is shown to be occupying at least a portion of that locking aperture 108*e* in FIG. 29. As shown in FIG. 29, the protrusion 442 is held in the locking aperture 108*e*, and this helps to hold the female housing 200 and the male housing 400 properly and fully mated together.

When the button 102, first latch beam 104, and second latch beam 106 move from the transitional position (FIGS. 22-25) to a subsequent preloaded position (FIGS. 26-29), there is an extra loud "click" sound caused by multiple surfaces hitting each other which can include, for example, one or more of the following: (1) the surface 110 hitting the surface 118; (2) the surface 112 hitting the surface 120; and (3) upper surfaces of latch beams 104, 106 hitting interior surfaces of the male housing 400.

The extra loud "click" sound, which occurs when the button 102, first latch beam 104, and second latch beam 106 move from the transitional position (FIGS. 22-25) to a subsequent preloaded position (FIGS. 26-29), provides a convenient assurance that the female housing 200 and the male housing 400 are properly and completely mated together.

According to the principles disclosed herein, a "click" sound is extra loud, when a female housing is completely and properly mated with a male housing, for multiple reasons which can include at least the following reasons, for example: (A) first, the connector latch on a female housing was manufactured to be in an extended and relaxed undeflected position (this position is shown in FIG. 4, wherein the button 102 extends upward away from the bottom 138, for example); (B) second, after manufacturing, the connector latch on the female housing was subjected to a pre-mating process to deflect the button 102 downward in a direction toward the bottom 138, thus moving the connector latch to a preloaded position prior to the mating of the female housing with a male housing, such that the top surface of the button 102 is a distance D below a top surface 136 of the female housing, and such that the latch beams 104 and 106 have the curvatures as shown in FIGS. 13A and 13B; (C) third, all of the surfaces contacting each other as a result of performing step three of the above-discussed three-step mating process come together with significant force resulting in an extra loud "click" sound; and (4) the female housing and the male housing are mated together with force.

Figure 30:
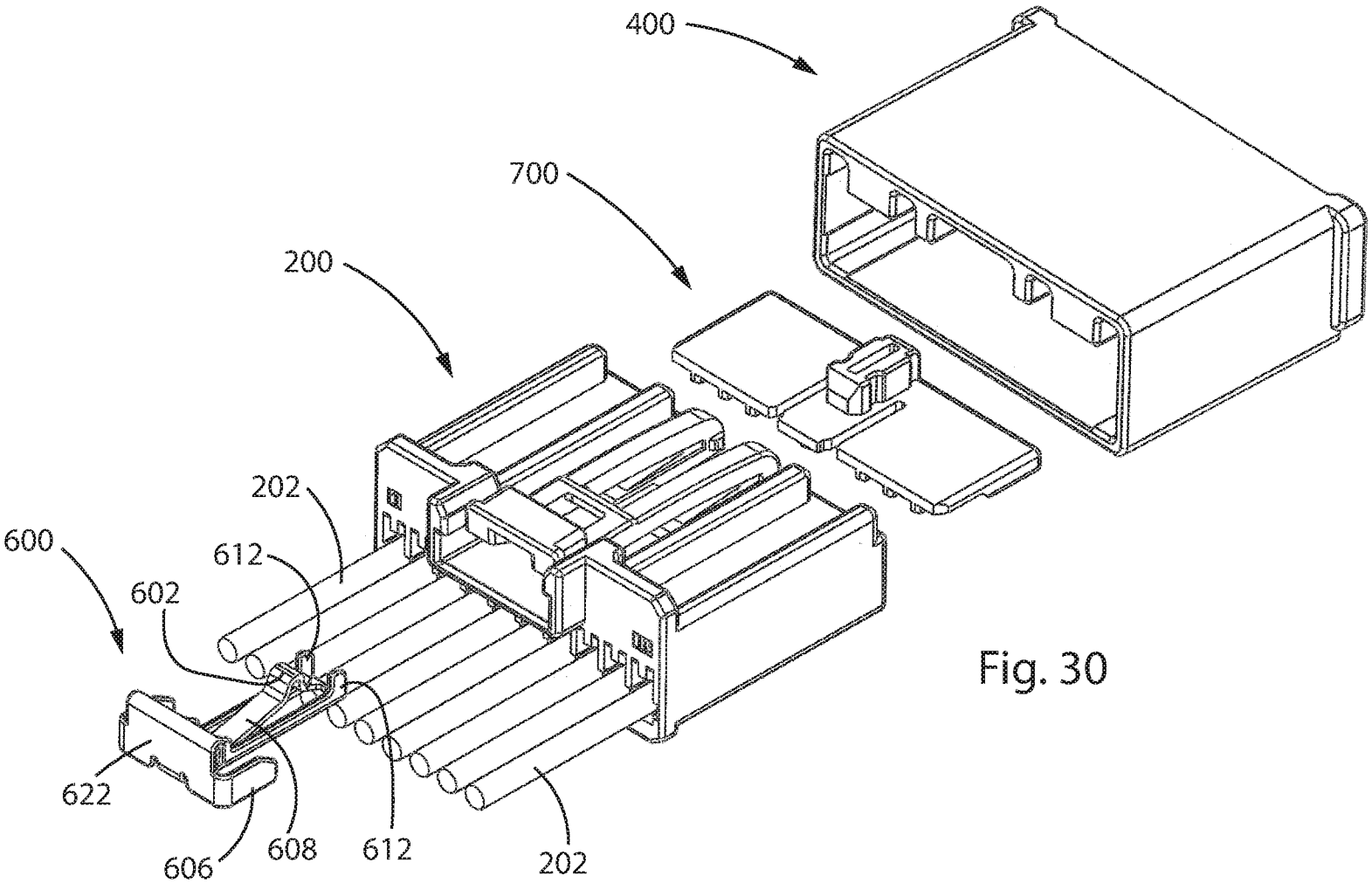
FIG. 30 is an exploded perspective view of a female housing, a connector position assurance (CPA) unit, a terminal position assurance (TPA) unit, and a male housing, wherein the female housing has a connector latch in accordance with the principles of the present invention.

FIG. 30 is an exploded perspective view of a female housing, a connector position assurance (CPA) unit, a terminal position assurance (TPA) unit, and a male housing, wherein the female housing has a connector latch in accordance with the principles of the present invention.

FIG. 30 depicts the female housing 200, an optional connector position assurance (CPA) unit 600, an optional terminal position assurance (TPA) unit 700, the male housing 400, and wires 202. The CPA 600 can be received by the aperture 134 of the female housing. The TPA 700 can be received by the aperture 140 of the female housing.

As shown in FIG. 30, the CPA unit 600 includes a first curved upper region 602, at least one tooth 612, an upper component 608 of a two-component locking system, at least one arm 606, and a back 622.

Figure 31:
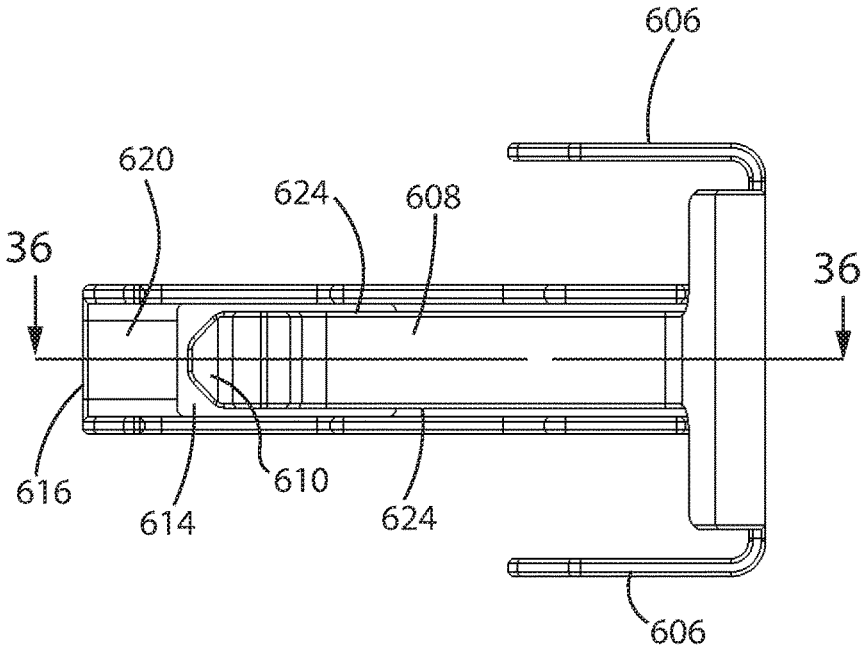
FIG. 31 is a top elevational view of a connector position assurance (CPA) unit.
Figure 32:
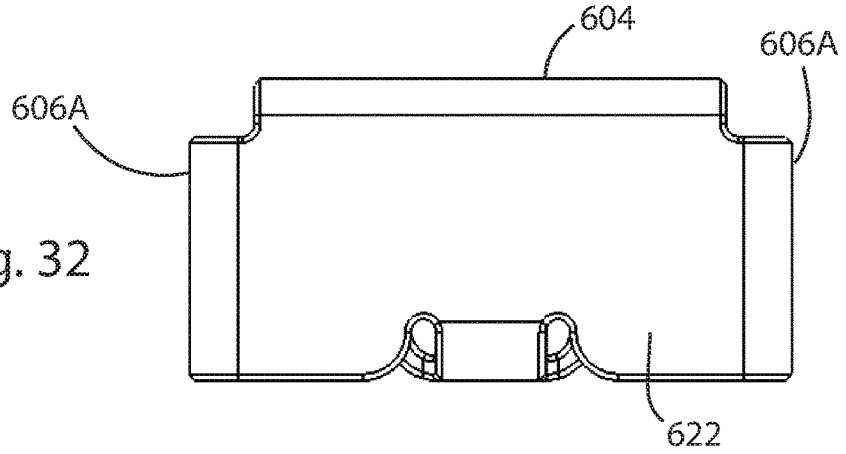
FIG. 32 is a rear end elevational view of the CPA unit shown in FIG. 31.
Figure 33:
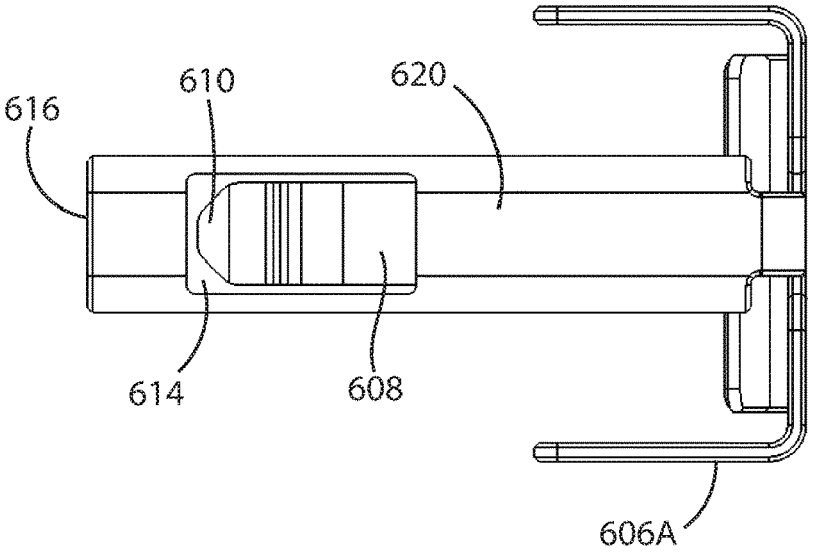
FIG. 33 is a bottom elevational view of the CPA unit shown in FIG. 31.
Figure 34:
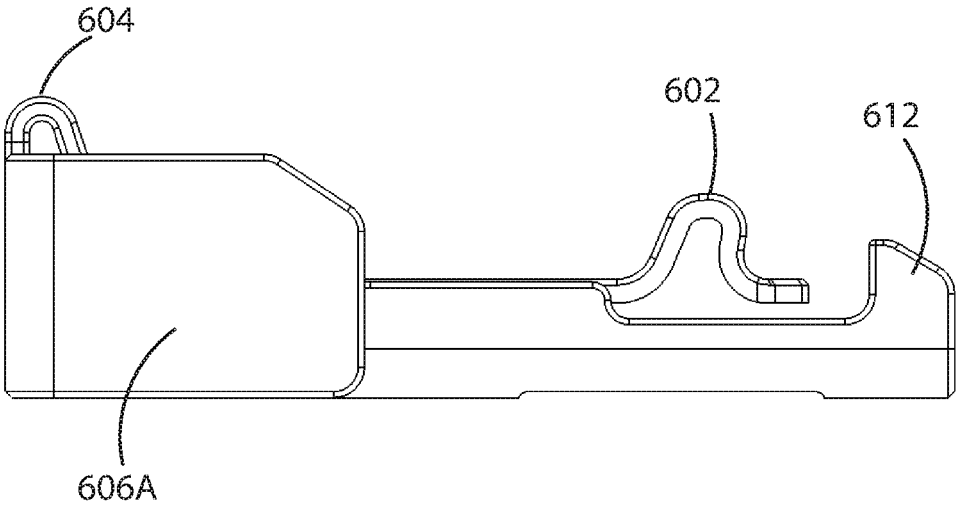
FIG. 34 is a side end elevational view of the CPA unit shown in FIG. 31.

FIG. 31 is a top elevational view of a connector position assurance (CPA) unit. FIG. 32 is a rear end elevational view of the CPA unit shown in FIG. 31. FIG. 33 is a bottom elevational view of the CPA unit shown in FIG. 31. FIG. 34 is a side end elevational view of the CPA unit shown in FIG.

Figure 35:
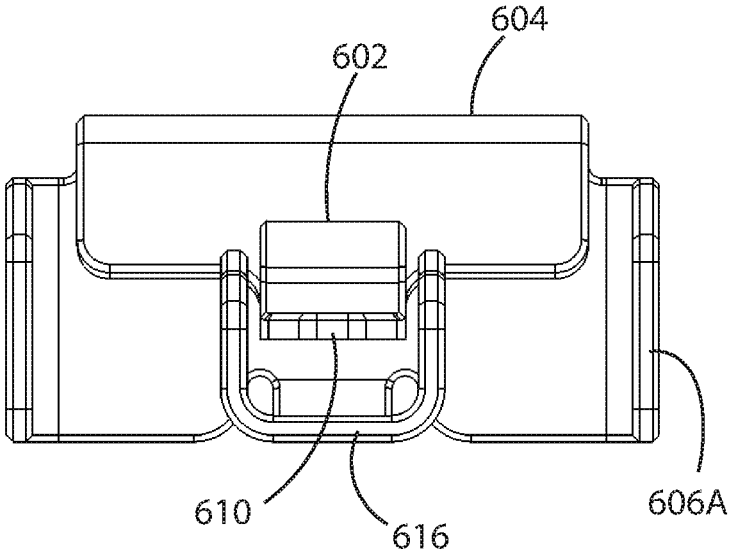
FIG. 35 is a front end elevational view of the CPA unit shown in FIG. 31.
Figure 36:
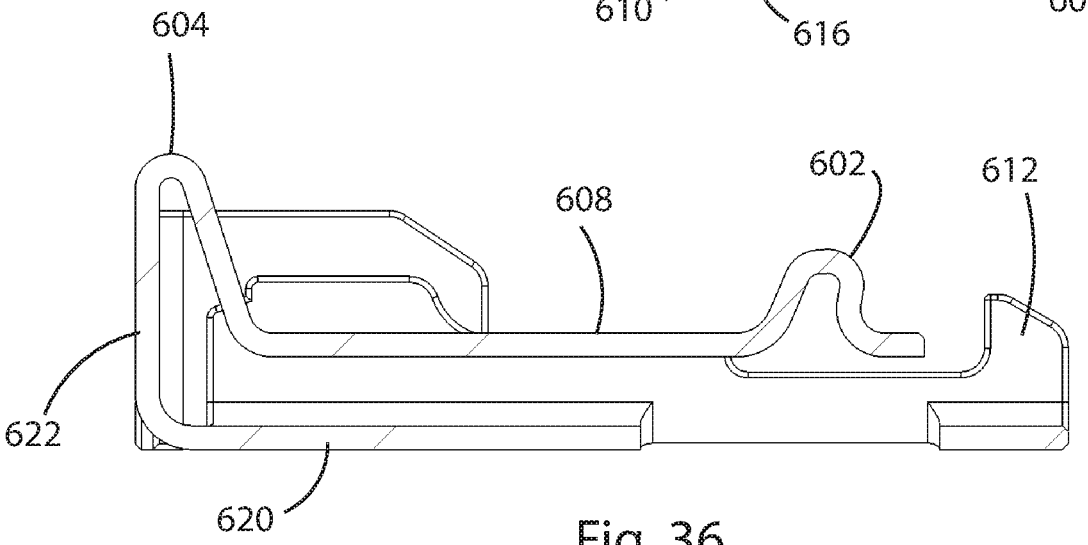
FIG. 36 is a cross-sectional view, taken along line 36-36 in FIG. 31.
Figure 37:
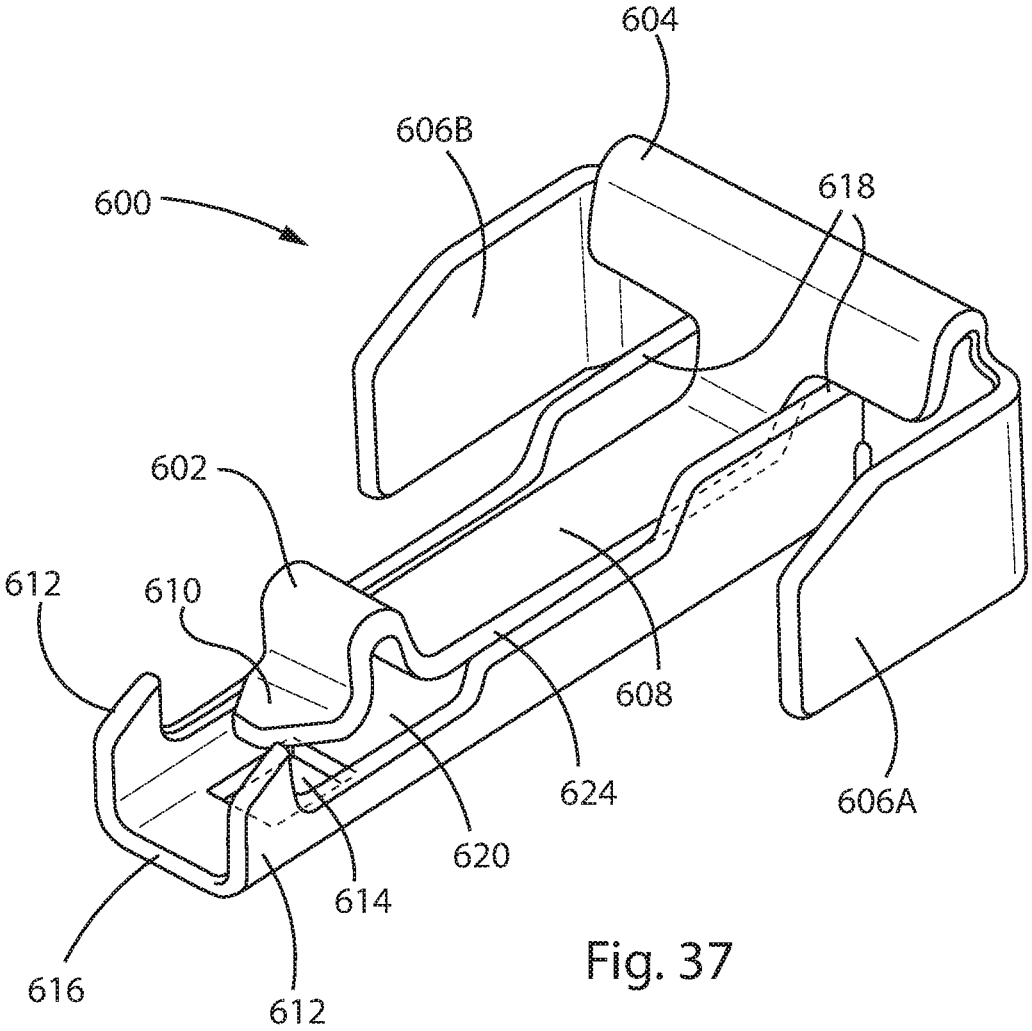
FIG. 37 is a perspective view of the CPA unit shown in FIG. 31.

31. FIG. 35 is a front end elevational view of the CPA unit shown in FIG. 31. FIG. 36 is a cross-sectional view, taken along line 36-36 in FIG. 31. FIG. 37 is a perspective view of the CPA unit shown in FIG. 31.

FIG. 31 shows that the CPA unit 600 has a pair of arms 606. FIG. 37 shows an exterior surface 606A of one of the arms 606, and also shows an interior surface 606B of one of the arms 606. The exterior surfaces 606A of arms 606 have flat and smooth surfaces. The exterior surfaces 606A do not have protrusions extending outward away from the CPA unit 600. Thus, the arms 606 can slide into the aperture 134 of the female housing. The CPA unit 600 can be formed from one piece of material. In order for the CPA unit 600 to be formed from one piece of material, the piece of material must be cut, bent, and/or manipulated in a predetermined manner.

The CPA unit 600 includes a two-component locking system having an upper component 608 and a lower component 620. The upper component 608 can also be referred to as a flexible beam. The upper component 608 is able to flex downward toward the lower component 620, for example. The upper component 608 extends forward from the second curved upper region 604 toward a front 616 of the CPA unit 600. The upper component 608 has a front end 610 and side edges 624.

The lower component 620 extends forward from the back 622 toward the front 616 of the CPA unit 600. The lower component 620 forms an aperture 614. Edges of the lower component 620 are curved upward. The edges of the lower component 620 are referred to by reference numeral 618.

As shown in FIG. 31, for example, the side edges 624 are flat and smooth, and do not have protrusions extending outward toward edges 618 of the lower component 620. FIG. 37 also shows side edge 624 to be flat and smooth.

When the CPA unit 600 is being moved from the pre-lock position to the full-lock position, the rear edge 108*b* of the latch surface 108 of the connector latch forces the first curved upper region 602 to move downward towards the aperture 614 or into the aperture 614.

The front end 610 of the upper component 608 has a surface that has rounded, smooth edges, as shown in FIG. 31, for example. According the embodiment of the CPA unit 600 as shown in FIG. 37, for example, the front end 610 of the upper component 608 is not split into multiple different sections.

The CPA unit 600, with the above-described features and structural arrangements, can be in a pre-lock position when inserted into the aperture 134 of the female housing. The CPA unit 600, with the above-described features and structural arrangements, can be moved from a pre-lock position to a full-lock position when the CPA unit 600 is moved deeper into the aperture 134 of the female housing.

The full-lock position of the CPA unit 600 assures the full engagement, and subsequent locking, of the female housing 200 to the male housing 400.

Figure 38:
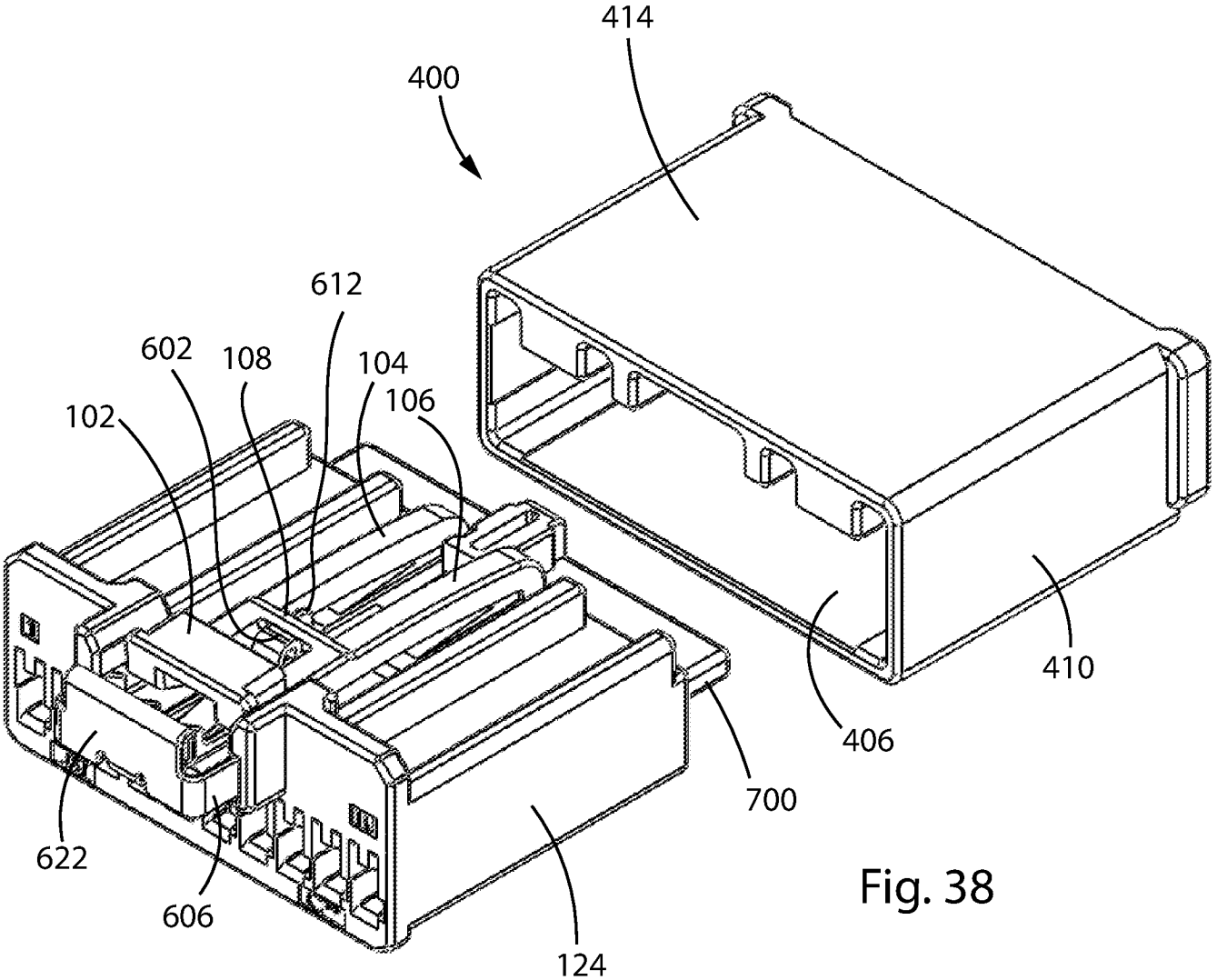
FIG. 38 is an exploded perspective view of a female housing and a male housing, depicting step one of a three-step mating process, wherein the female housing has a connector latch in accordance with the principles of the present invention, showing the connector latch in a pre-loaded position, with a connector position assurance (CPA) unit shown in the pre-lock position.

FIG. 38 is an exploded perspective view of a female housing and a male housing, depicting step one of a three-step mating process, wherein the female housing has a connector latch in accordance with the principles of the present invention, showing the connector latch in a pre-loaded position, with a connector position assurance (CPA) unit shown in the pre-lock position.

Figure 39:
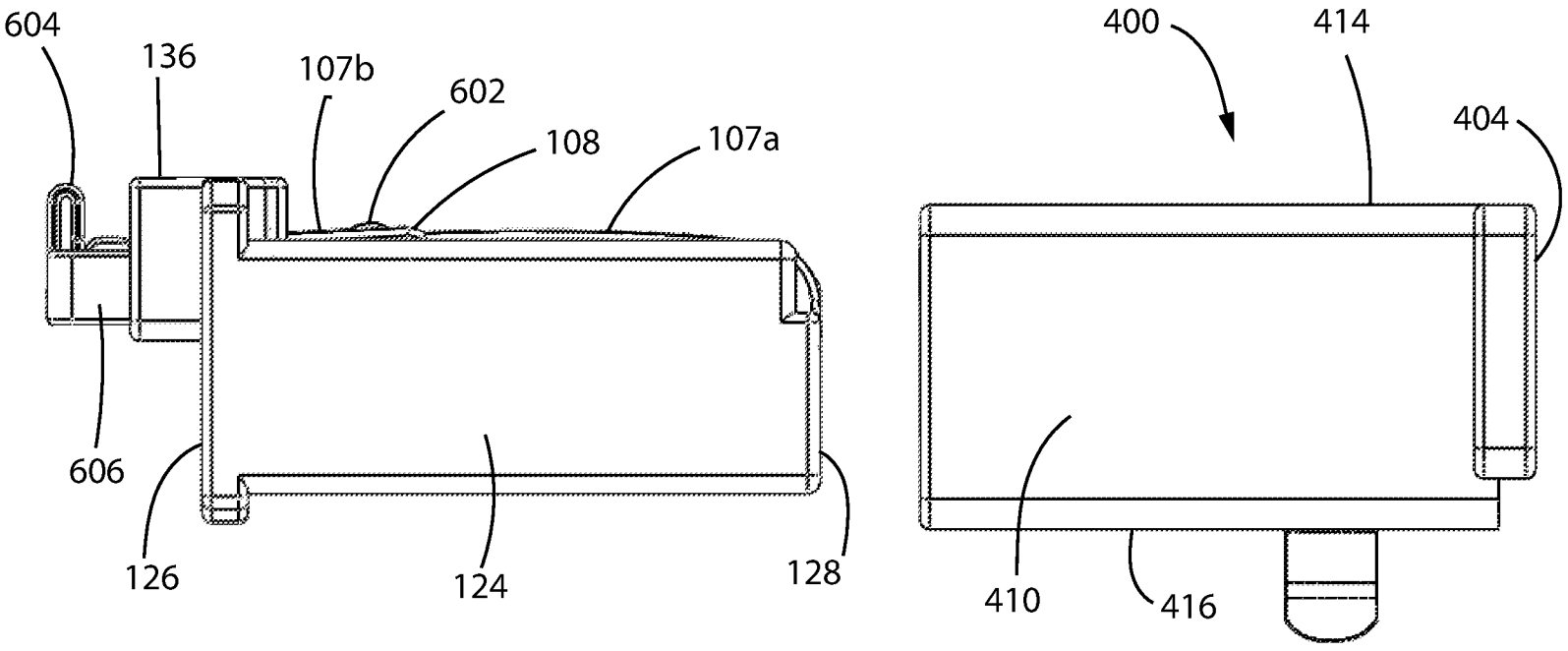
FIG. 39 is a side elevational view of the configuration shown in FIG. 38.
Figure 40:
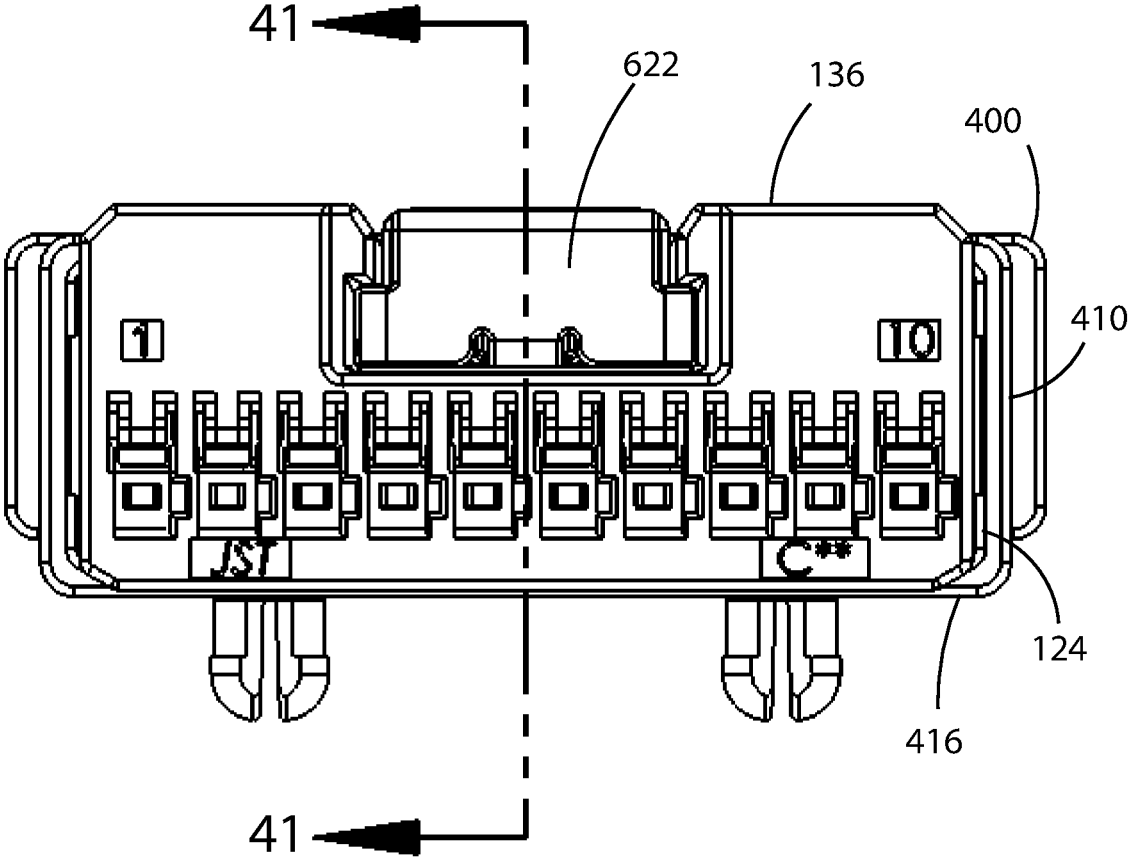
FIG. 40 is a front end elevational view of the configuration shown in FIG. 38.
Figure 41:
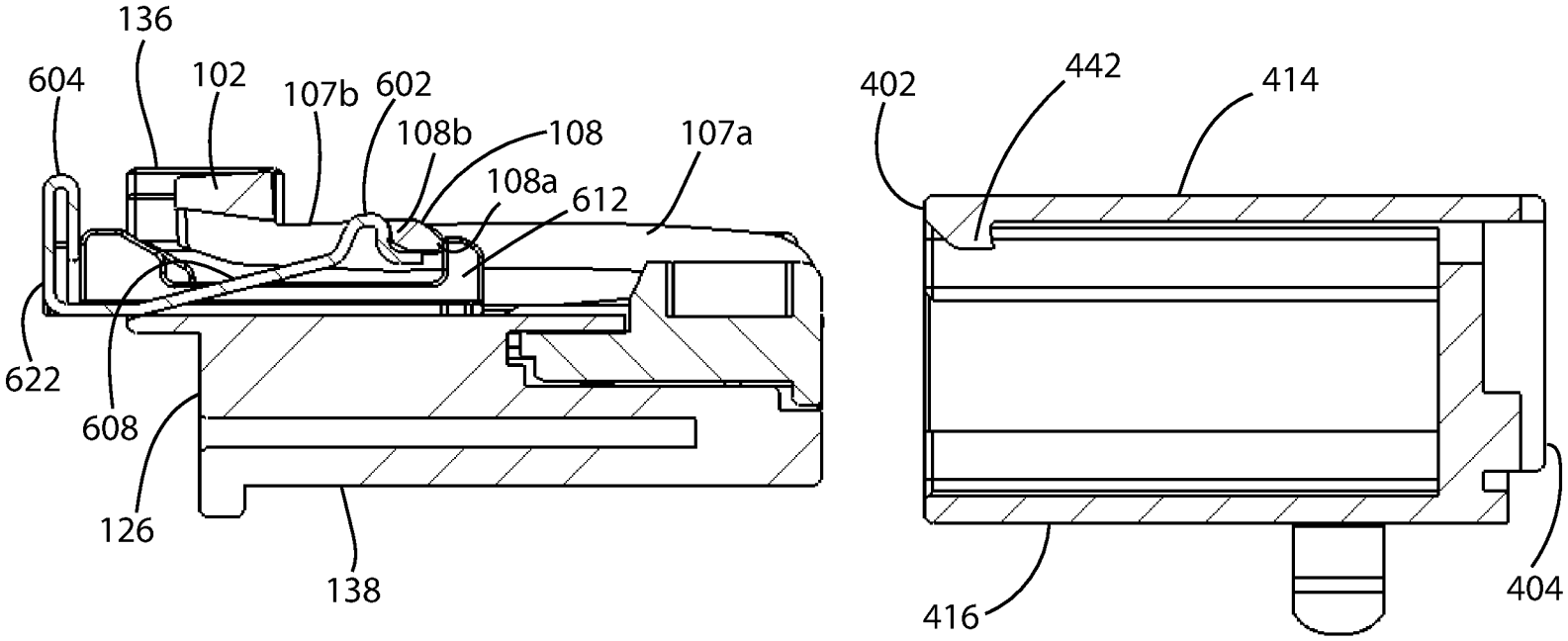
FIG. 41 is a cross-sectional view, taken along line 41-41 in FIG. 40.

FIG. 39 is a side elevational view of the configuration shown in FIG. 38. FIG. 40 is a front end elevational view of the configuration shown in FIG. 38. FIG. 41 is a cross-sectional view, taken along line 41-41 in FIG. 40.

In FIG. 41, the CPA unit 600 is in the pre-lock position, and the rear edge 108*b* is in a position to engage the first curved upper region 602. The rear edge 108*b* forces the first curved upper region 602 to move downward towards aperture 614, or into aperture 614, when the CPA unit 600 is moved from the pre-lock position to the full-lock position.

Figure 42:
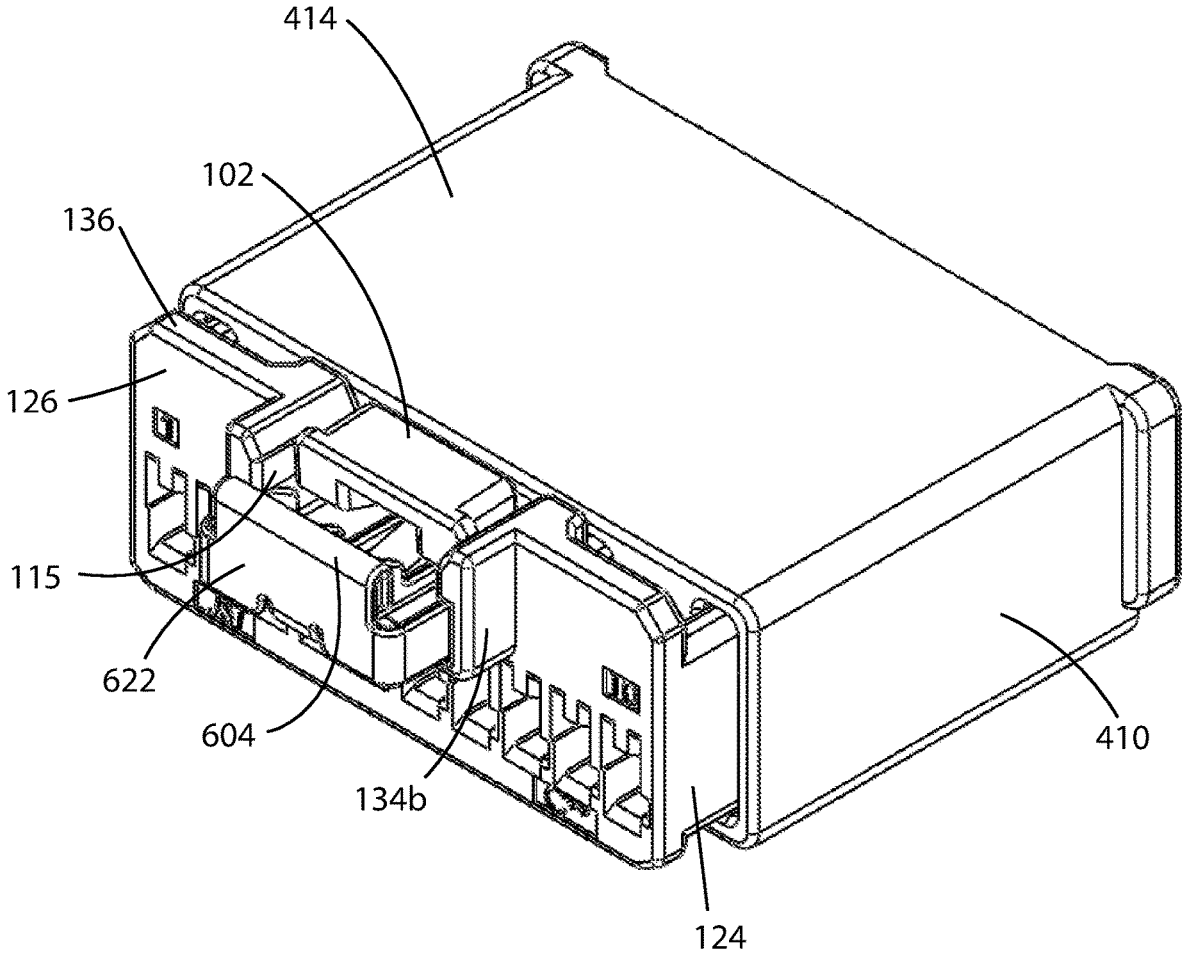
FIG. 42 is a perspective view of a female housing and a male housing, depicting step two of a three-step mating process, wherein the female housing has a connector latch in accordance with the principles of the present invention, with a connector position assurance (CPA) unit shown in the pre-lock position.

FIG. 42 is a perspective view of a female housing and a male housing, depicting step two of a three-step mating process, wherein the female housing has a connector latch in accordance with the principles of the present invention, with a connector position assurance (CPA) unit shown in the pre-lock position.

Figure 43:
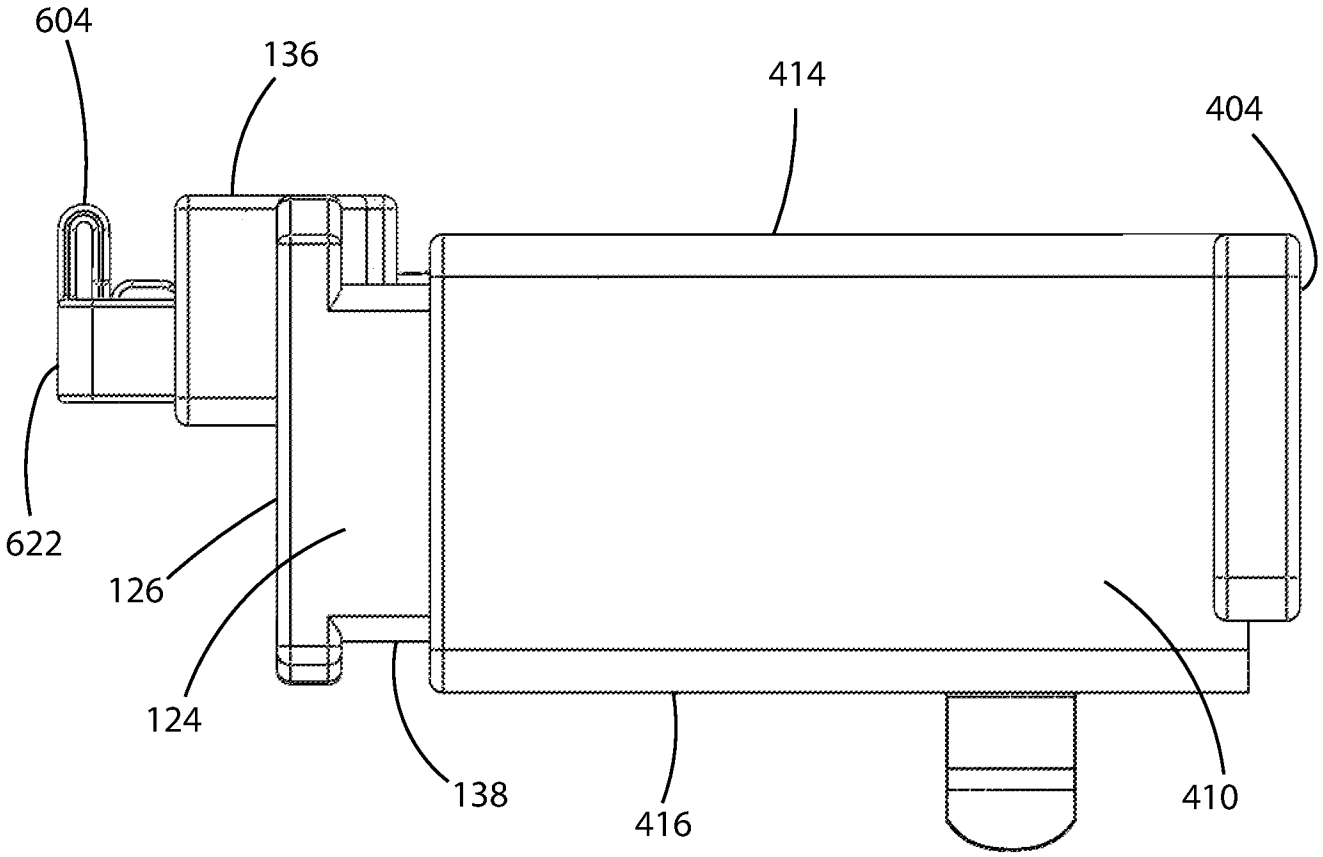
FIG. 43 is a side elevational view of the configuration shown in FIG. 42.
Figure 44:
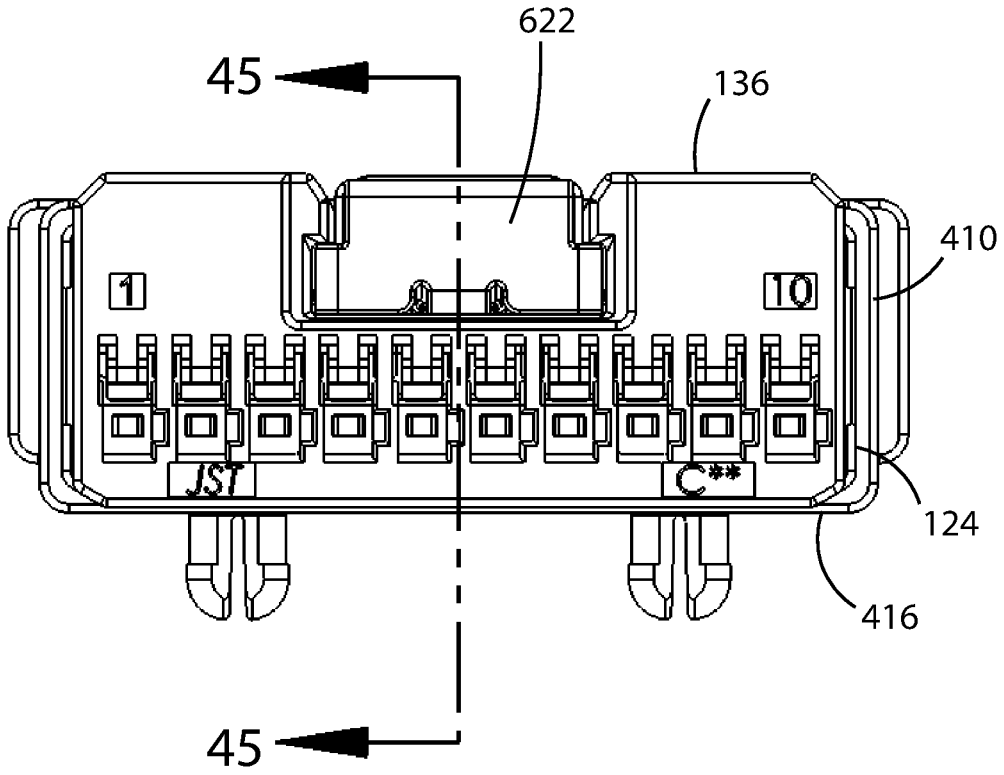
FIG. 44 is a front end elevational view of the configuration shown in FIG. 42.
Figure 45:
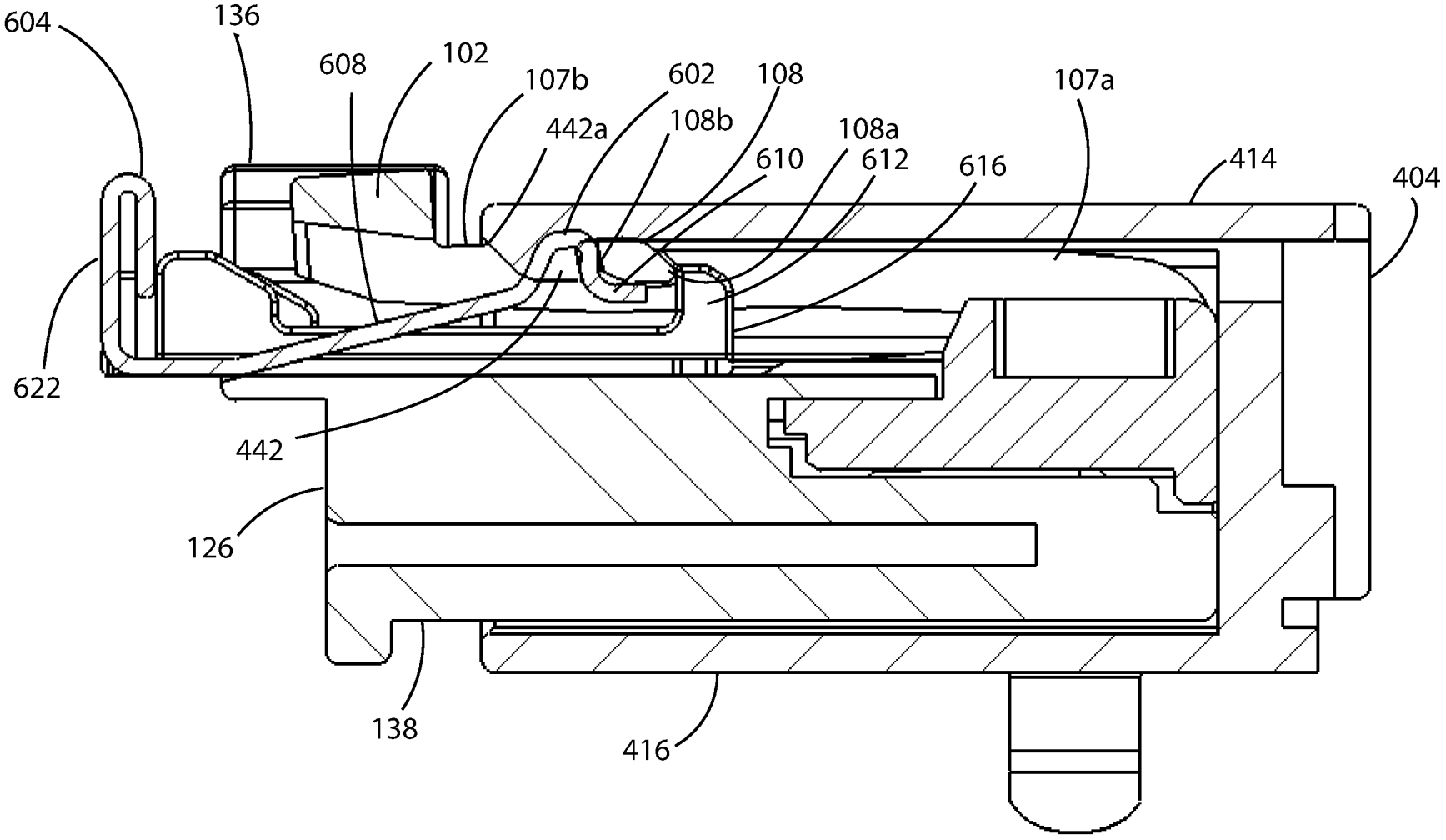
FIG. 45 is a cross-sectional view, taken along line 45-45 in FIG. 44.

FIG. 43 is a side elevational view of the configuration shown in FIG. 42. FIG. 44 is a front end elevational view of the configuration shown in FIG. 42. FIG. 45 is a cross-sectional view, taken along line 45-45 in FIG. 44.

Figure 46:
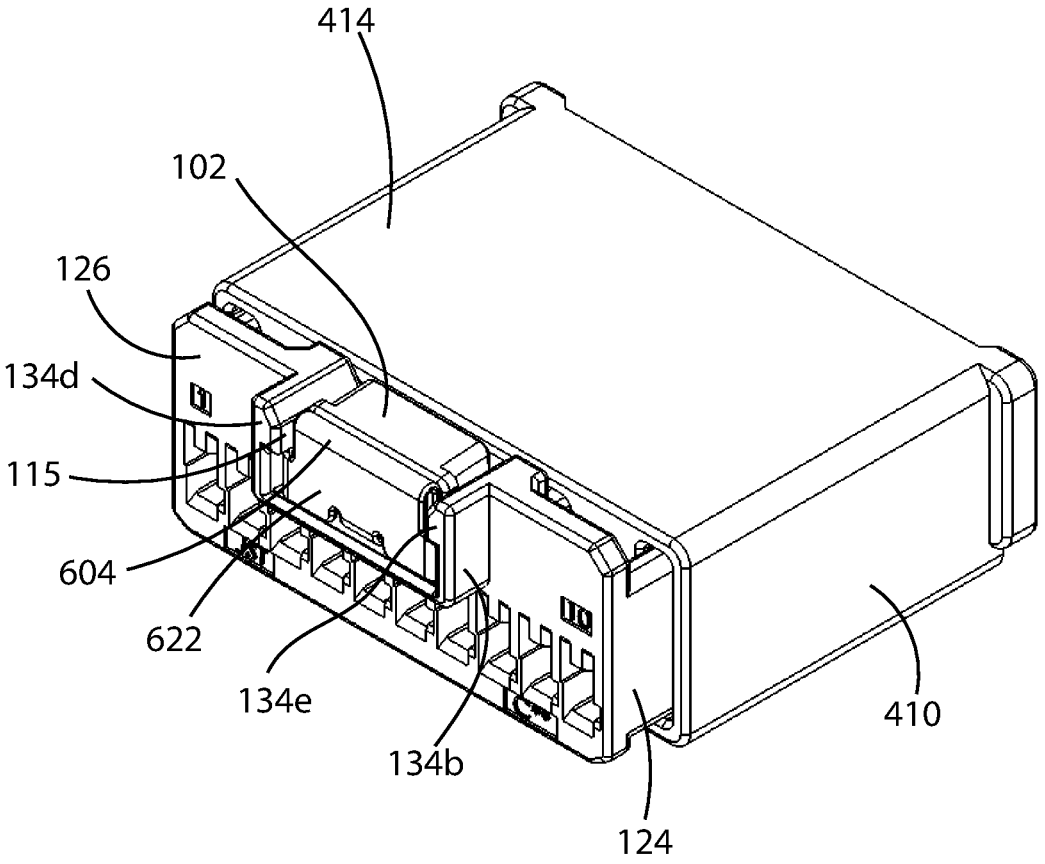
FIG. 46 is a perspective view of a female housing and a male housing, depicting step three of a three-step mating process, wherein the female housing has a connector latch in accordance with the principles of the present invention, with a connector position assurance (CPA) unit shown in the full-lock position.

FIG. 46 is a perspective view of a female housing and a male housing, depicting step three of a three-step mating process, wherein the female housing has a connector latch in accordance with the principles of the present invention, with a connector position assurance (CPA) unit shown in the full-lock position.

Figure 47:
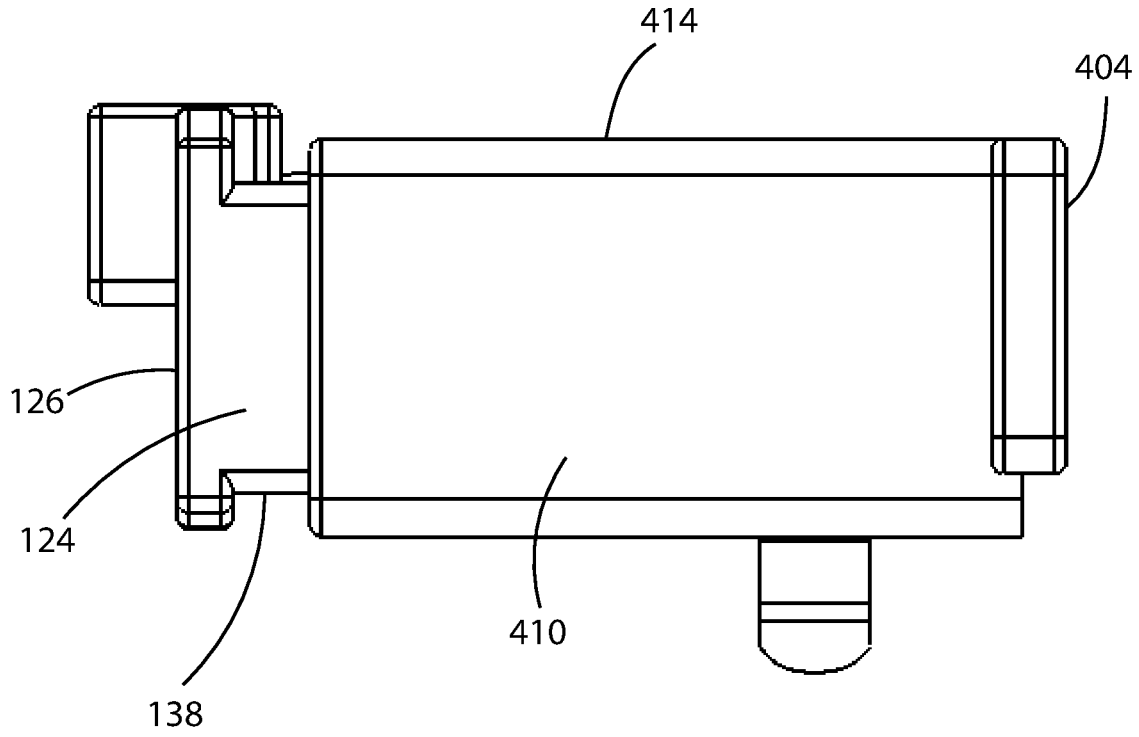
FIG. 47 is a side elevational view of the configuration shown in FIG. 46.
Figure 48:
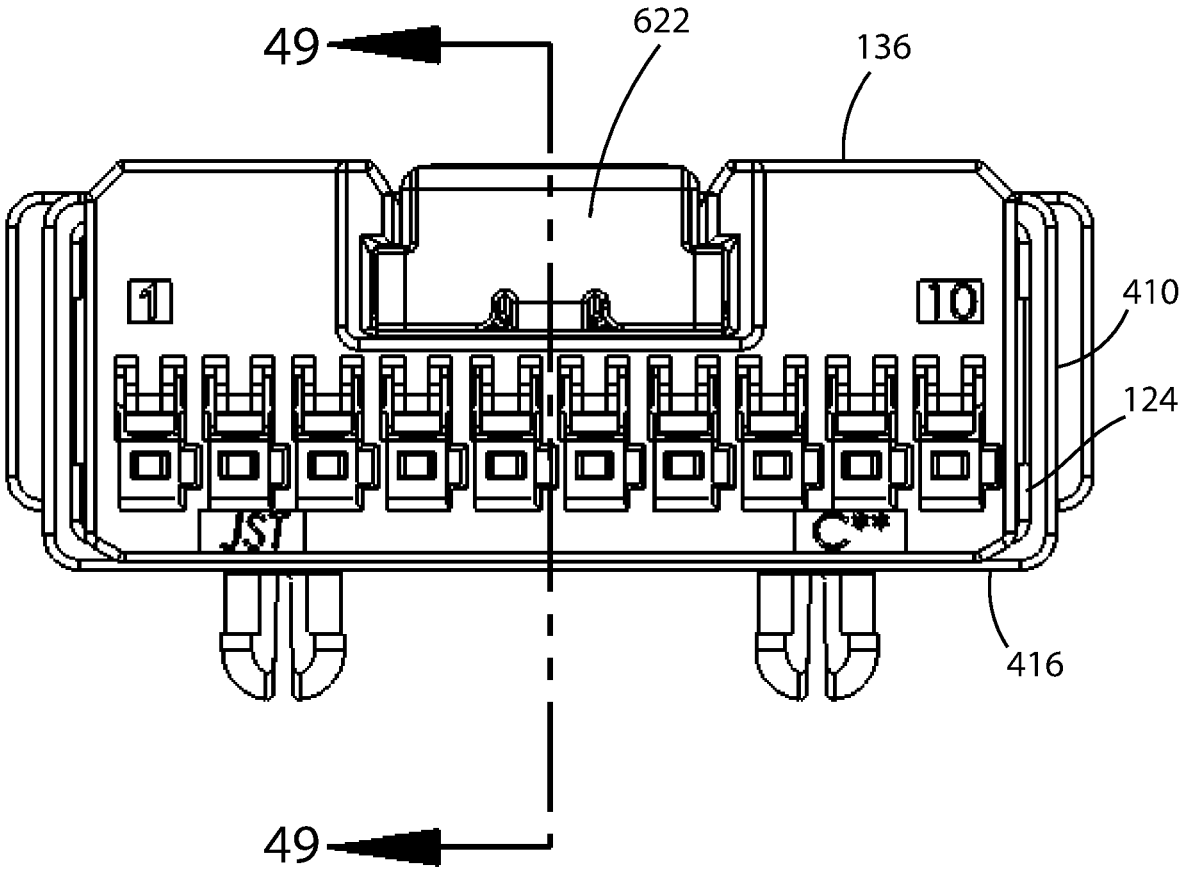
FIG. 48 is a front end elevational view of the configuration shown in FIG. 46.
Figure 49:
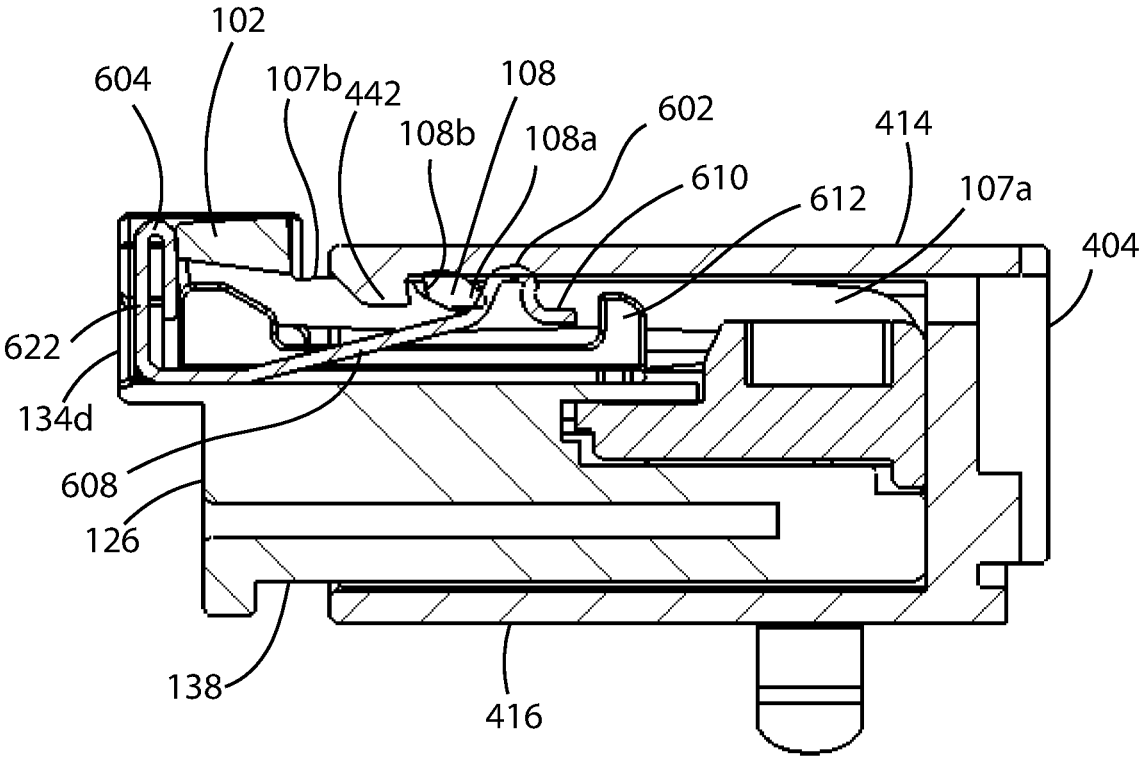
FIG. 49 is a cross-sectional view, taken along line 49-49 in FIG. 48.

FIG. 47 is a side elevational view of the configuration shown in FIG. 46. FIG. 48 is a front end elevational view of the configuration shown in FIG. 46. FIG. 49 is a cross-sectional view, taken along line 49-49 in FIG. 48. FIG. 49 depicts the CPA unit 600 in the full-lock position.

A method for assembling the female housing 200, male housing 400, and CPA unit 600 shall now be described. The CPA unit 600 is inserted into the aperture 134 of the female housing 200. The teeth 612 will travel under the latch surface 108 of the connector latch of the female housing 200. When the teeth 612 travel beyond the latch surface 108 of the connector latch of the female housing 200, as shown in FIG. 41, and the first curved upper region 602 has not yet passed under the latch surface 108, this can be referred to as the pre-lock position. In the pre-lock position, the first curved upper region 602 is directly contacting the rear edge 108*b*, and the teeth 612 are directly contacting the front edge 108*a*, as shown in FIG. 41.

Next, the male housing 400 is connected to the female housing 200, by inserting the female housing 200 into the aperture 406 of the male housing 400.

Last, the CPA unit 600 is moved from the pre-lock position to the full-lock position as described herein. The first curved upper region 602 will travel under the latch surface 108 of the connector latch of the female housing 200. When the first curved upper region 602 travels beyond the latch surface 108, as shown in FIG. 49, this is the full-lock position. In the full-lock position, the first curved upper region 602 is directly contacting the front edge 108*a*, and the protrusion 442 is at the rear edge 108*b*, as shown in FIG. 49.

The first overstress protection surface 110 on a side of the button 102, as shown in FIG. 2, extends outward away from the button 102 toward the general direction of the first frame 114. The top side of surface 110 (visible in FIG. 2), and the bottom side of surface 118 (depicted in FIG. 7) are shown to be flat surfaces in the drawings, but other types of surfaces may be contemplated, consistent with the principles disclosed herein, so that an audible "click" sound results when the surfaces 110 and 118 hit each other, after the protrusion 442 pushes the latch surface 108 down (as shown in FIG. 25) and subsequently lets the latch surface 108 go up again (as shown in FIG. 29).

A connector latch can be formed without the second latch beam 106, consistent with the principles of the present invention, and still be functional. When there is no second latch beam 106, the latch surface 108 will extend outward from a side of the first latch beam 104, and the button 102 will be at the distal end of the first latch beam 104. In this embodiment, an aperture is formed by the area between the button 102, first latch beam 104, and the latch surface 108. The protrusion 442 will be located in that aperture when a female housing is properly and fully mated with a male housing, in accordance with the principles disclosed herein.

A first housing having a connector latch of the present invention can be represented by the female housing 100, the female housing 200, or other housing, for example. A second housing can be represented by the male housing 400, or other housing, for example. The connector latch, the first housing, the second housing, the CPA unit, and/or the TPA unit can be made from one or more plastic materials and/or other materials.

It can be said that a first housing has a connector latch, and that connector latch includes at least the button 102, the first latch beam 104, the second latch beam 106, the latch surface 108, and other features, for example.

Alternatively, it can be said that a connector latch comprises features including at least a first housing (for example, the female housing 100), the button 102, the first latch beam 104, the second latch beam 106, the latch surface 108, the first overstress protection surface 110 on the button 102, the first overstress protection surface 118 on the first frame 114 of the first housing, the second overstress protection surface 112 on the button 102, the second overstress protection surface 120 on the second frame 116 of the first housing.

The second overstress protection surface 112 on a side of the button 102, as shown in FIG. 1, extends outward away from the button 102 toward the general direction of the second frame 116. The top of surface 112 (depicted in FIG. 1), and the bottom of surface 120 (depicted in FIG. 7), are shown to be flat surfaces in the drawings, but other types of surfaces may be contemplated, consistent with the principles disclosed herein, so that an audible "click" sound results when the surfaces 112 and 120 hit each other, after the protrusion 442 pushes the latch surface 108 down (as shown in FIG. 25) and subsequently lets the latch surface 108 go up again (as shown in FIG. 29).

Although FIG. 37 shows an embodiment wherein the CPA unit 600 has two teeth 612, it can be understood that, according to an alternative embodiment, the CPA unit 600 can be modified to have only one tooth 612. In the alternative embodiment wherein the CPA unit 600 has only one tooth 612, a first one of the two edges 618 will extend upward near the front 616 to form a tooth 612 as shown in FIG. 37, and a second one of the two edges 618 will not extend upward near the front 616 and thus there will be no second tooth 612.

Although the foregoing description is directed to the preferred embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

LIST OF REFERENCE NUMERALS

100 Female housing (depicted with connector latch in an undeflected position)
102 Button of connector latch
102*a* First side wall of button
102*b* Second side wall of button
103*a* First side front edge of button
103*b* Second side front edge of button
104 First latch beam of connector latch
104*a* First side of first latch beam
104*b* Second side of first latch beam
104*c* Hinge area of first latch beam
105*a* Lower section of first latch beam
105*b* Upper section of first latch beam
106 Second latch beam of connector latch
106*a* First side of second latch beam
106*b* Second side of second latch beam
106*c* Hinge area of second latch beam
107*a* Lower section of second latch beam
107*b* Upper section of second latch beam
108 Latch surface of connector latch
108*a* Front edge of latch surface of connector latch
108*b* Rear edge of latch surface of connector latch
108*c* Lower section of latch surface of connector latch
108*d* Upper section of latch surface of connector latch
108*e* Aperture formed by connector latch
110 First overstress protection surface (upper surface) on first side of button
112 Second overstress protection surface (upper surface) on second side of button
114 First frame of female housing
115 First interior side wall of female housing
116 Second frame of female housing
117 Second interior side wall of female housing
118 First overstress protection surface (lower surface) on first frame of female housing
120 Second overstress protection surface (lower surface) on second frame of female housing
122 First side of female housing
124 Second side of female housing
126 Front of female housing
128 Rear of female housing
130 Terminal aperture on front of female housing
132 Terminal aperture on rear of female housing
134 Aperture for receiving optional connector position assurance (CPA) unit
134*a* First side wall of aperture 134
134*b* Second side wall of aperture 134
134*c* Wall of aperture 134, lower side
134*d* Front edge of first side wall of aperture 134
134*e* Front edge of second side wall of aperture 134
136 Top of female housing
138 Bottom of female housing
140 Aperture for receiving optional terminal position assurance (TPA) unit
142 First rib on first side of female housing
144 First rib on second side of female housing
146 Rear surface of front wall on first side of female housing
148 Rear surface of front wall on second side of female housing
200 Female housing (depicted with connector latch in a preloaded position)
202 Wires in terminal apertures on front of female housing
400 Male housing
402 Front of male housing 400
404 Rear of male housing 400
406 Aperture for receiving rear 128 of female housing
408 First side of male housing 400
410 Second side of male housing 400
414 Top of male housing 400
416 Bottom of male housing 400
442 Protrusion on male housing 400

442*a* Front upper point of protrusion 442
442*b* Rear upper point of protrusion 442
442*c* Rear lower point of protrusion 442
442*d* Front lower point of protrusion 442 (Embodiment One, FIG. 21)
442*e* Front lower point of protrusion 442 (Embodiment Two, FIG. 25)
442*f* Front mid-range point of protrusion 442 (Embodiment Two, FIG. 25)
600 Connector position assurance (CPA) unit, which can be inserted into aperture 134
602 First curved upper region of CPA unit 600
604 Second curved upper region of CPA unit 600
606 Arm of CPA unit 600
606A Exterior surface of arm 606
606B Interior surface of arm 606
608 Upper component of two-component locking system of CPA unit 600
610 Front end of upper component 608
612 Tooth of CPA unit 600
614 Aperture formed by lower component 620
616 Front of CPA unit 600
618 Edges of lower component 620
620 Lower component of two-component locking system of CPA unit 600
622 Back of CPA unit 600
624 Side edges of upper component 608
700 Terminal position assurance (TPA) unit, which can be inserted into aperture 140
A1 Location representing the highest point of the upper surface of the upper section 107*b*, when the connector latch is in a preloaded position
A2 Location representing the highest point of the upper surface of the lower section 107*a*, when the connector latch is in a preloaded position
D Distance measured from the upper surface of the button 102 to the upper surface of the top 136 of the female housing 200, when the connector latch is in a preloaded position
H1 Height measured from the top surface of the first rib 144 to the location A1, when the connector latch is in a preloaded position
H2 Height measured from the top surface of the first rib 144 to the location A2, when the connector latch is in a preloaded position
H3 Height measured from the top surface of the first rib 144 to the top surface of the upper section 107*b* of the second latch beam 106, at a location near to the rear surface 148, when the connector latch is in a preloaded position

I claim:

1. A method of operating a connector latch for a housing, comprising:

moving a button of a connector latch from a first position on a first housing to a second position on said first housing, and to a third position, wherein said first housing has at least a first surface and an upper surface, said button has at least a first surface and an upper surface, said connector latch has at least a first latch beam, when said connector latch is in said first position, said first surface of said button does not engage with said first surface of said first housing, said first surface of said button is above said first surface of said first housing, and said upper surface of said button is above said upper surface of said first housing, when said connector latch is in said second position, said first surface of said button is below said first surface of said first housing, and said first surface of said button does not engage said first surface of said first housing, when said connector latch is in said third position, said first surface of said button is below said first surface of said first housing, and said first surface of said button engages with said first surface of said first housing, said moving of said button from said first position to said second position is performed when said upper surface of said button moves down, and said moving of said button from said second position to said third position is performed when said upper surface of said button moves up.

2. The method of claim 1, wherein when said moving of said button from said first position to said second position is performed, at least a first section of said first latch beam changes from being not curved to being curved.

3. The method of claim 1, wherein said first housing has at least a second surface, said button has at least a second surface, said second surface of said button does not engage with said second surface of said first housing when said connector latch is in said first position, and said second surface of said button engages with said second surface of said first housing when said connector latch is in said third position.

4. The method of claim 3, wherein said first housing has a first frame, and said first surface of said first housing is on said first frame, and said first housing has a second frame, and said second surface of said first housing is on said second frame.

5. The method of claim 1, wherein a second latch beam is disposed between said button and said first housing, and a latch surface is on said first and second latch beams.

6. The method of claim 5, wherein said button, said first latch beam, said second latch beam, and said latch surface form at least one aperture.

7. The method of claim 1, wherein at least a first section of said first latch beam is spaced apart from at least a first section of a second latch beam.

8. The method of claim 1, further comprising:

moving said first housing into an aperture of a second housing, wherein said connector latch emits an audible sound when said first housing is moved into the aperture of said second housing.

9. The method of claim 1, further comprising:

mating said first housing with a second housing, wherein said connector latch emits an audible sound when said mating is performed.

10. The method of claim 9, wherein said second housing forms a protrusion, and said connector latch emits the audible sound when said protrusion disengages from a latch surface during said mating.

11. The method of claim 1, further comprising:

Receiving said first housing into an aperture of a second housing, wherein said second housing forms a protrusion, wherein said protrusion engages with a latch surface and disengages with said latch surface during said receiving, and said connector latch emits an audible sound when said protrusion disengages from said latch surface during said receiving.

* * * * *